US009377714B2

(12) United States Patent
Nakazawa et al.

(10) Patent No.: US 9,377,714 B2
(45) Date of Patent: Jun. 28, 2016

(54) DEVELOPER ACCOMMODATING UNIT WITH FRAMES FOR ACCOMMODATING A DEVELOPER ACCOMMODATING MEMBER

(71) Applicant: CANON KABUSHIKI KAISHA, Tokyo (JP)

(72) Inventors: Ryosuke Nakazawa, Yokohama (JP); Yosuke Kashiide, Tokyo (JP); Hiroyuki Munetsugu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/099,038

(22) Filed: Dec. 6, 2013

(65) Prior Publication Data

US 2015/0139684 A1 May 21, 2015

(30) Foreign Application Priority Data

Dec. 14, 2012 (JP) ..... 2012-273200
Feb. 4, 2013 (JP) ..... 2013-019145
Nov. 15, 2013 (JP) ..... 2013-236404

(51) Int. Cl.
*G03G 15/08* (2006.01)
*G03G 21/18* (2006.01)

(52) U.S. Cl.
CPC ..... *G03G 15/0874* (2013.01); *G03G 15/0843* (2013.01); *G03G 21/1814* (2013.01)

(58) Field of Classification Search
CPC ..... G03G 15/0843; G03G 15/0874; G03G 15/0882; G03G 21/1814
USPC ..... 399/105–106, 119, 262; 220/9.1, 9.4, 220/495.01, 495.06; 141/10
See application file for complete search history.

(56) References Cited

U.S. PATENT DOCUMENTS 4,766,457 A * 8/1988 Barker et al. ..... 399/106
5,075,727 A * 12/1991 Nakatomi ..... 399/103
5,079,591 A * 1/1992 Tomita et al. ..... 399/262
5,594,535 A * 1/1997 Beaufort et al. ..... 399/262
5,802,431 A * 9/1998 Nagashima et al. ..... 399/262
6,898,405 B2 * 5/2005 Matsumoto et al. ..... 399/262
7,245,853 B2 * 7/2007 Muramatsu et al. ..... 399/120
7,650,103 B2 * 1/2010 Isomura ..... 399/262

(Continued)

FOREIGN PATENT DOCUMENTS

CN 103454881 A 12/2013
JP H04-66980 3/1992

OTHER PUBLICATIONS

Mar. 25, 2016 Office Action in Chinese Patent Application No. 201310681924.8 (with English translation).

*Primary Examiner* — Clayton E Laballe
*Assistant Examiner* — Trevor J Bervik
(74) *Attorney, Agent, or Firm* — Fitzpatrick, Cella, Harper & Scinto

(57) ABSTRACT

A developer accommodating unit for accommodating a developer, including: a flexible container, provided with an opening for permitting discharge of the developer, for accommodating the developer; a sealing member for sealing the opening; and a frame, including a first frame and a second frame, for accommodating the flexible container in a space formed by mounting the first frame to the second frame and for accommodating the developer discharged through the opening of the flexible container when the opening is unsealed. The flexible container is deformed adjacent to longitudinal end portions thereof in a mounting direction of the first frame toward the second frame.

30 Claims, 13 Drawing Sheets

(56) References Cited

U.S. PATENT DOCUMENTS

| | | | | |
|---|---|---|---|---|
| 8,121,517 | B2 | 2/2012 | Asanuma et al. | |
| 8,160,478 | B2 | 4/2012 | Munetsugu et al. | |
| 8,165,493 | B2 | 4/2012 | Chadani et al. | |
| 8,270,876 | B2 | 9/2012 | Morioka et al. | |
| 8,282,620 | B2 * | 10/2012 | Olson et al. | 604/408 |
| 8,369,744 | B2 | 2/2013 | Asanuma et al. | |
| 8,385,787 | B2 * | 2/2013 | Yamaguchi et al. | 399/258 |
| 8,559,849 | B2 | 10/2013 | Suzuki et al. | |
| 8,583,001 | B2 | 11/2013 | Kubo et al. | |
| 8,688,004 | B2 | 4/2014 | Asanuma et al. | |
| 2013/0209137 | A1 | 8/2013 | Hayashi et al. | |
| 2013/0308971 | A1 | 11/2013 | Kashiide et al. | |
| 2013/0322926 | A1 | 12/2013 | Matsunaga et al. | |
| 2014/0072327 | A1 | 3/2014 | Hayashi et al. | |
| 2014/0112686 | A1 | 4/2014 | Asanuma et al. | |

* cited by examiner

DEVELOPER ACCOMMODATING UNIT WITH FRAMES FOR ACCOMMODATING A DEVELOPER ACCOMMODATING MEMBER

FIELD OF THE INVENTION AND RELATED ART

The present invention relates to a developer accommodating unit for accommodating a developer, and a developing device, a process cartridge and an electrophotographic image forming apparatus which includes the developer accommodating unit.

Here, the image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine and the like. The process cartridge refers to a cartridge which is prepared by integrally mounting at least an image bearing member, a developer carrying member and a developer accommodating unit into a unit and which is made detachably mountable to an image forming apparatus or which is fastened to the image forming apparatus.

Further, the developer accommodating unit is to be accommodated in the image forming apparatus or the process cartridge. The developer accommodating unit at least includes a flexible container for accommodating the developer.

In a conventional electrophotographic image forming apparatus using an electrophotographic image forming process, a cartridge type in which consumables are integrally assembled into a cartridge and the cartridge is made detachably mountable to the image forming apparatus has been employed. As this cartridge, e.g., a process cartridge prepared by integrally assembling an electrophotographic photosensitive member and process means actable on the photosensitive member into a cartridge, and the developer accommodating unit or the like in which the developer is accommodated have been known.

In such a process cartridge, as shown in FIG. 9, an opening provided in a developer accommodating frame 31 for accommodating a developer (toner, carrier and the like) is sealed with a toner seal 32 as a sealing member. Further, during use, a bonding portion 33 of the toner seal 32 is peeled off to unseal the opening to permit supply of the developer. Such a type has been widely employed.

Further, a constitution in which in order to solve a problem of scattering of the developer in a cartridge in a developer filling step during manufacturing of the cartridge, a deformable developer accommodating container in which the developer is accommodated is used and accommodated in a frame has been proposed(Japanese Laid-Open Patent Application (JP-A) Hei 4-66980).

However, in order to realize lifetime extension of the cartridge without upsizing the image forming apparatus, to would be considered that the developer is accommodated in a larger amount in the developer accommodating container larger than the frame constituting the cartridge is accommodated in the frame by being depressed (deformed). In this case, there was a possibility that the frame is deformed by a repelling force of the deformable developer accommodating container. Further, by the deformation of the frame, there was a possibility that positions of members, such as a developer carrying member and a developing blade, supported by the frame were changed to lower an image quality.

SUMMARY OF THE INVENTION

A principal object of the present invention is to provide a developer accommodating unit and the like having a long lifetime without upsizing an image forming apparatus.

According to an aspect of the present invention, there is provided a developer accommodating unit for accommodating a developer, comprising: a flexible container, provided with an opening for permitting discharge of the developer, for accommodating the developer; a sealing member for sealing the opening; and a frame, including a first frame and a second frame, for accommodating the flexible container in a space formed by mounting the first frame to the second frame and for accommodating the developer discharged through the opening of the flexible container when the opening is unsealed, wherein the flexible container is deformed adjacent to longitudinal end portions thereof in a mounting direction of the first frame toward the second frame.

According to another aspect of the present invention, there are provided a developing device, a process cartridge and an image forming apparatus each including the developer accommodating unit.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (a), (b) and (c) of FIG. 1 are sectional views for illustrating a mounting process of a developer accommodating container into a first frame and a second frame.

Figure 4:
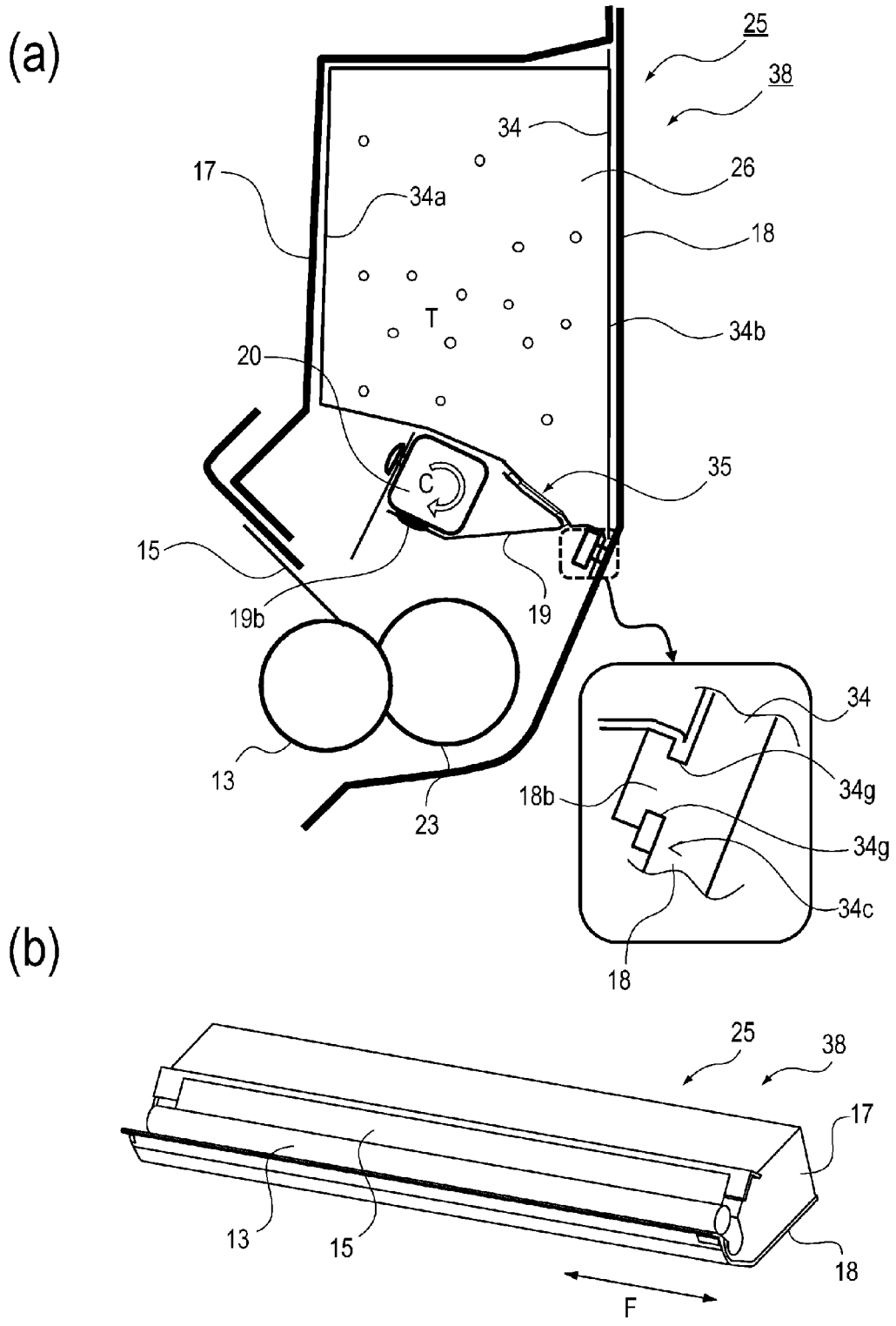

Parts (a) and (b) of FIG. 4 are schematic views for illustrating a structure of a developer accommodating unit.

Figure 5:
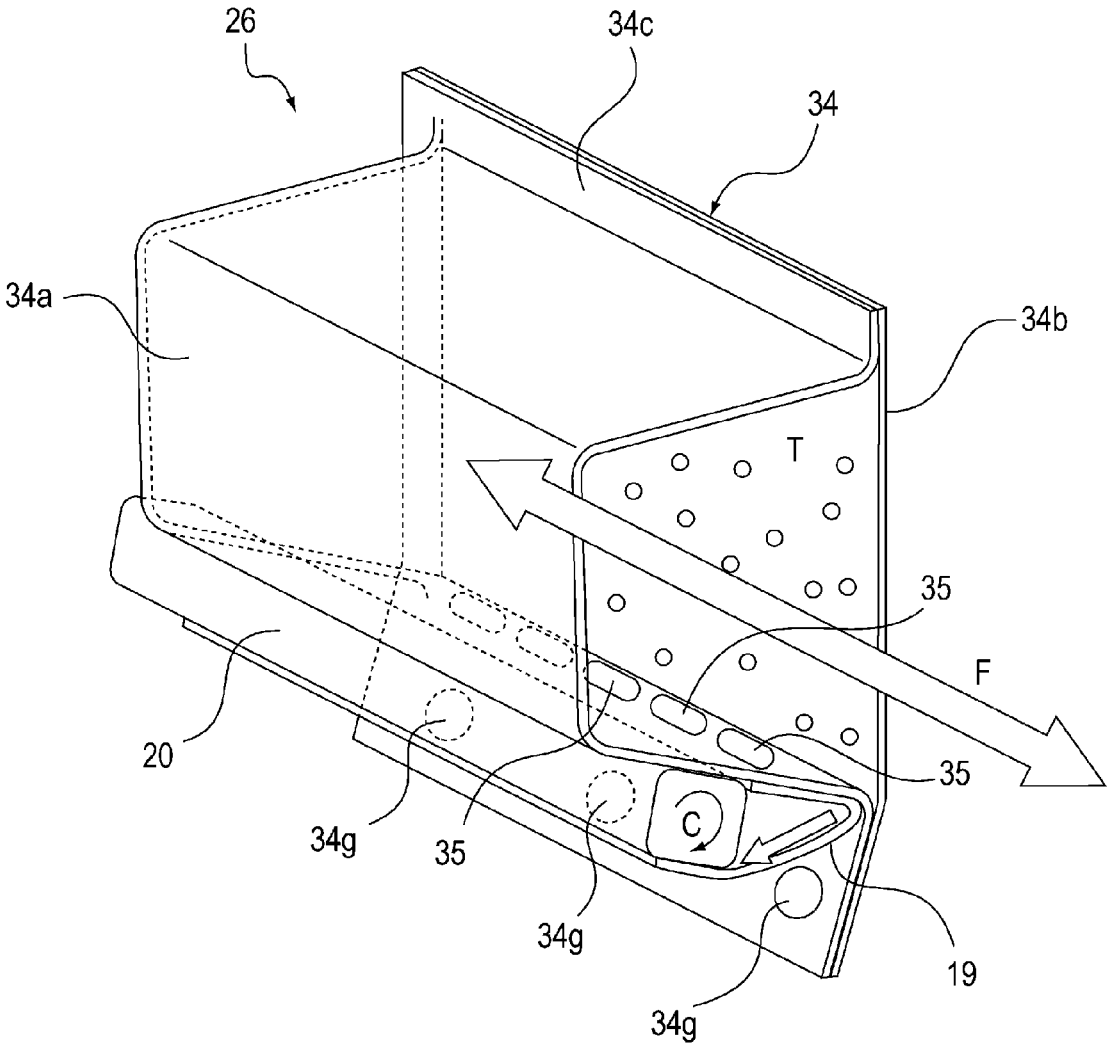

FIG. 5 is a perspective view for illustrating a structure of a developer accommodating container.

Figure 6:
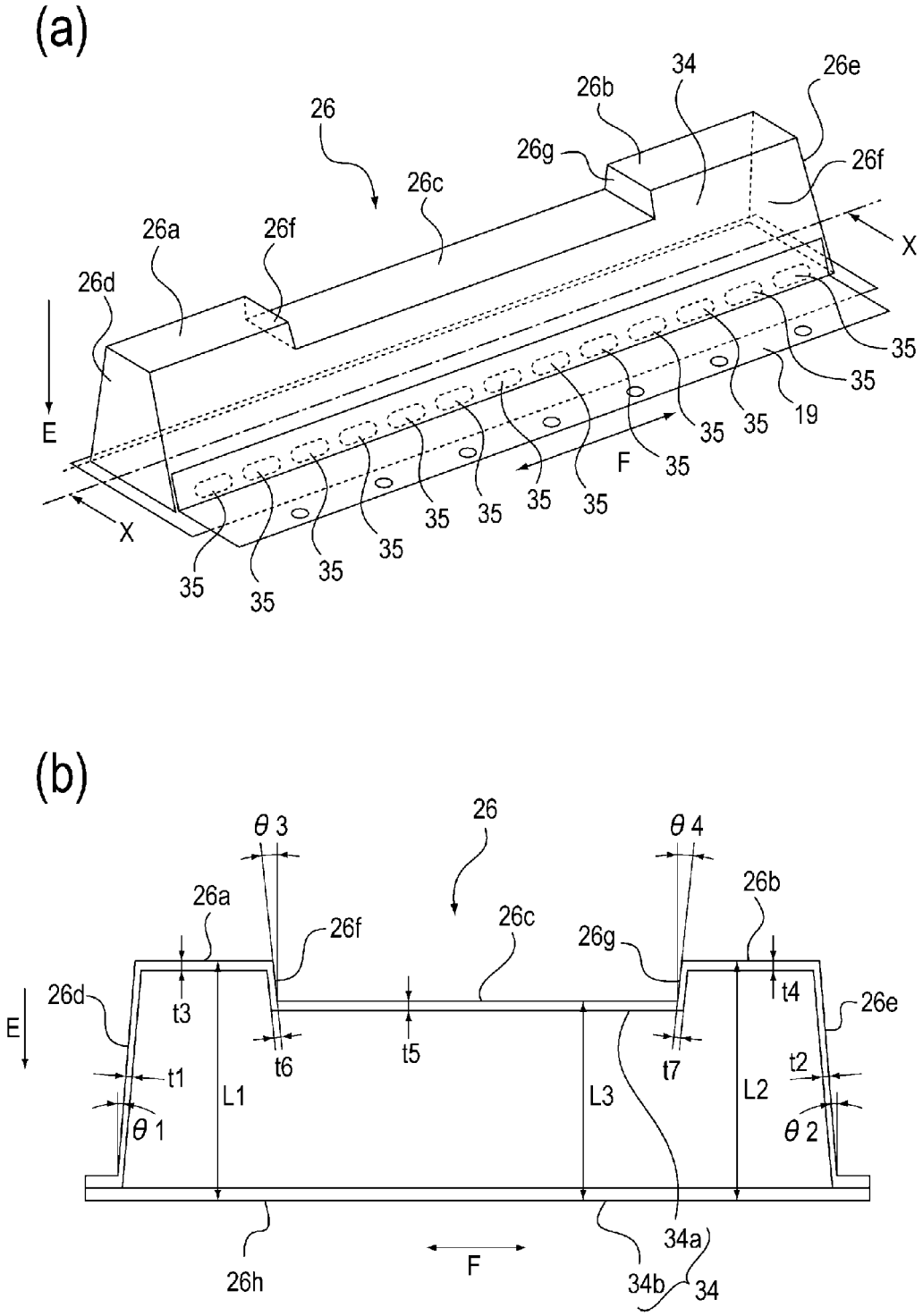

Parts (a) and (b) of FIG. 6 are schematic views for illustrating the structure of the developer accommodating container.

Figure 7:
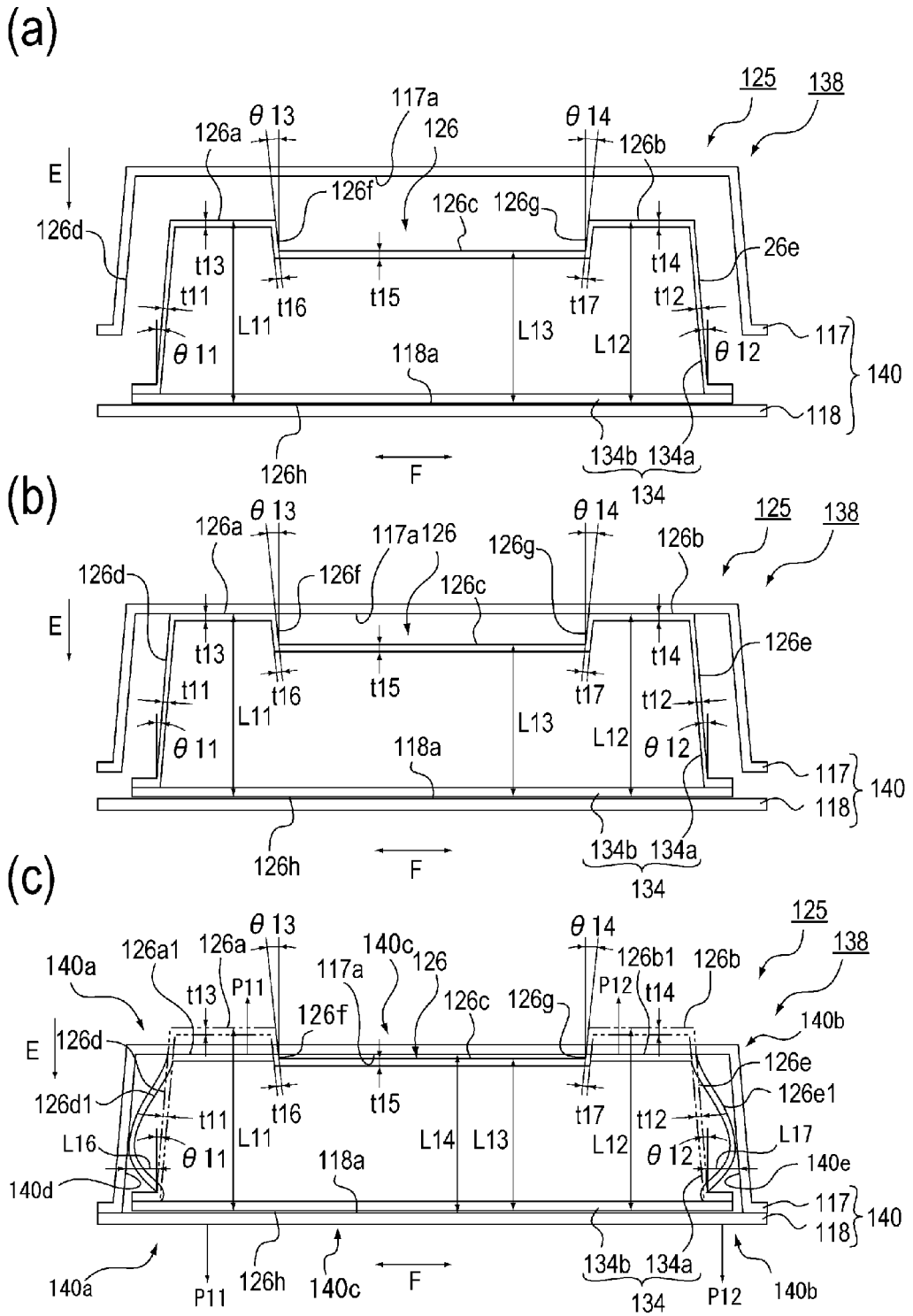

Parts (a), (b) and (c) of FIG. 7 are sectional views for illustrating a mounting process of a developer accommodating container into a first frame and a second frame.

Figure 8:
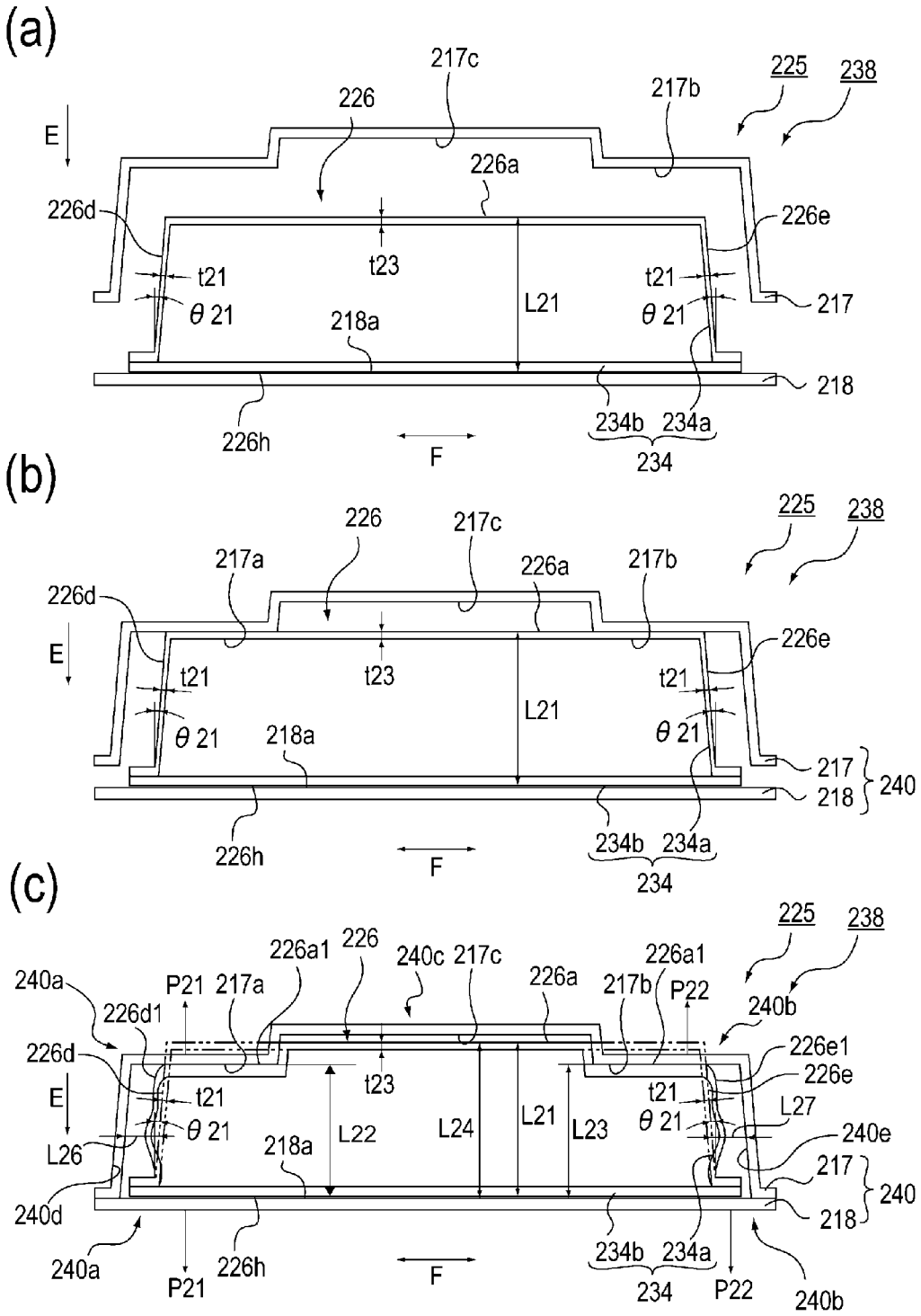

Parts (a), (b) and (c) of FIG. 8 are sectional views for illustrating a mounting process of a developer accommodating container into a first frame and a second frame.

Figure 9:
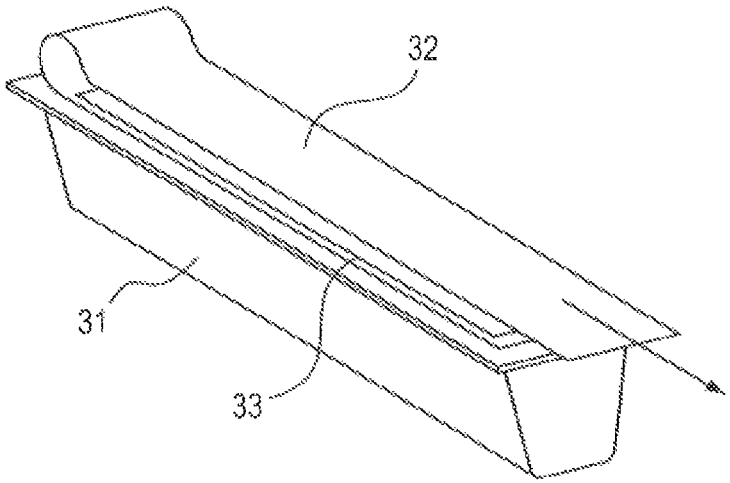
Fig. 9 PRIOR ART

FIG. 9 is a perspective view of a conventional developer accommodating container.

Figure 10:
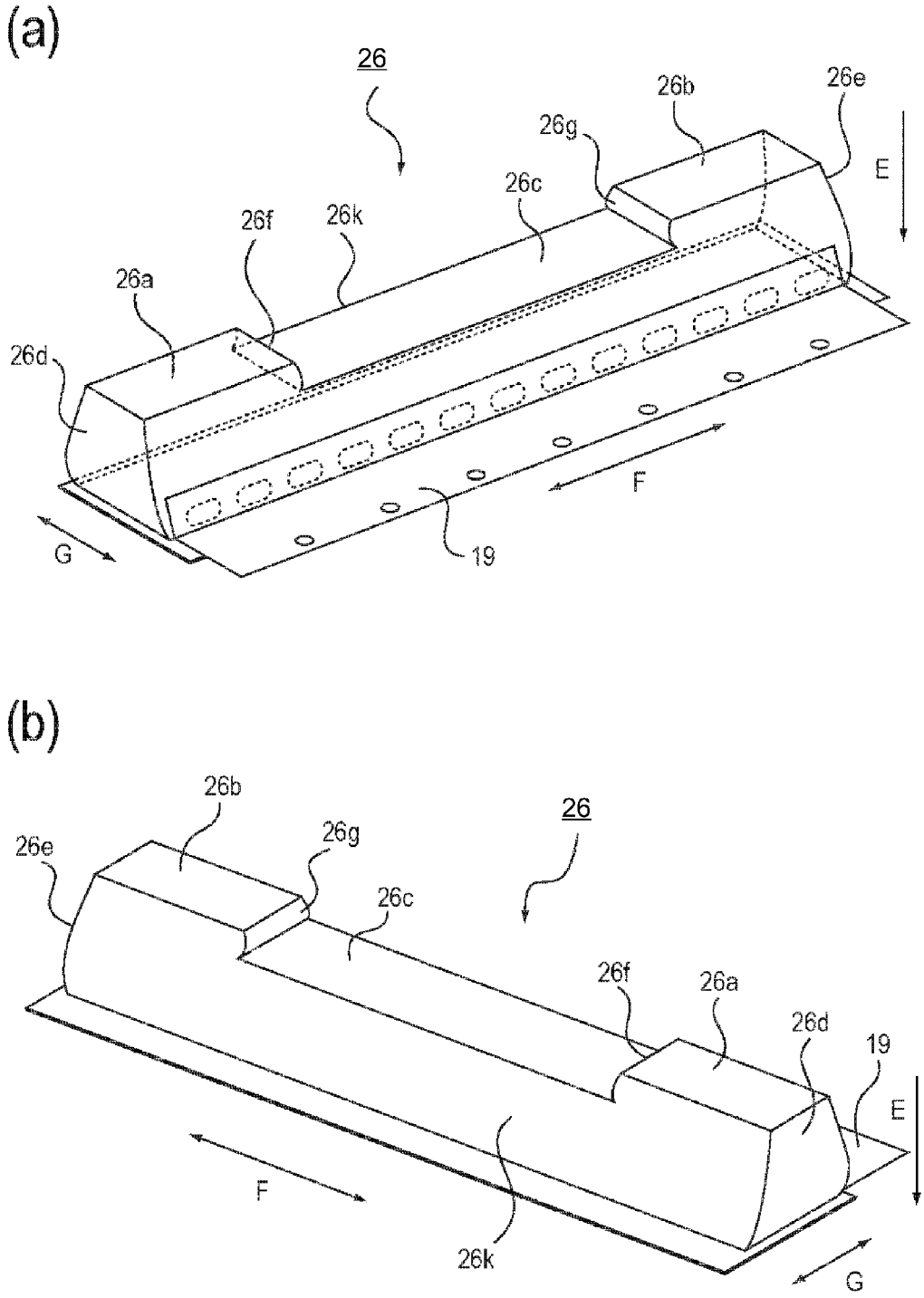

Parts (a) and (b) of FIG. 10 are perspective views for illustrating a structure of the developer accommodating container.

Figure 11:
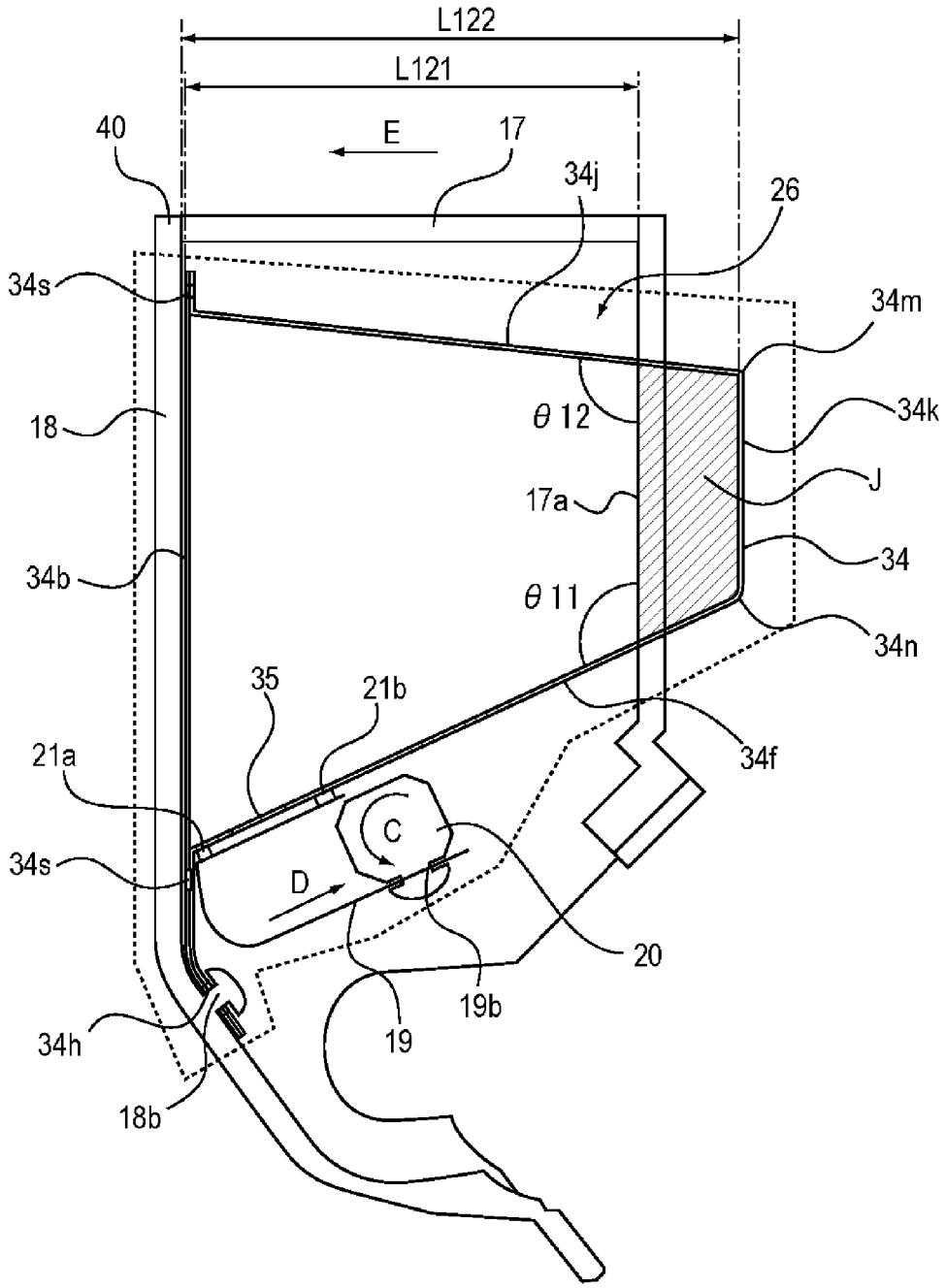

FIG. 11 is a sectional view for illustrating a structure of a developer accommodating unit.

Figure 12:
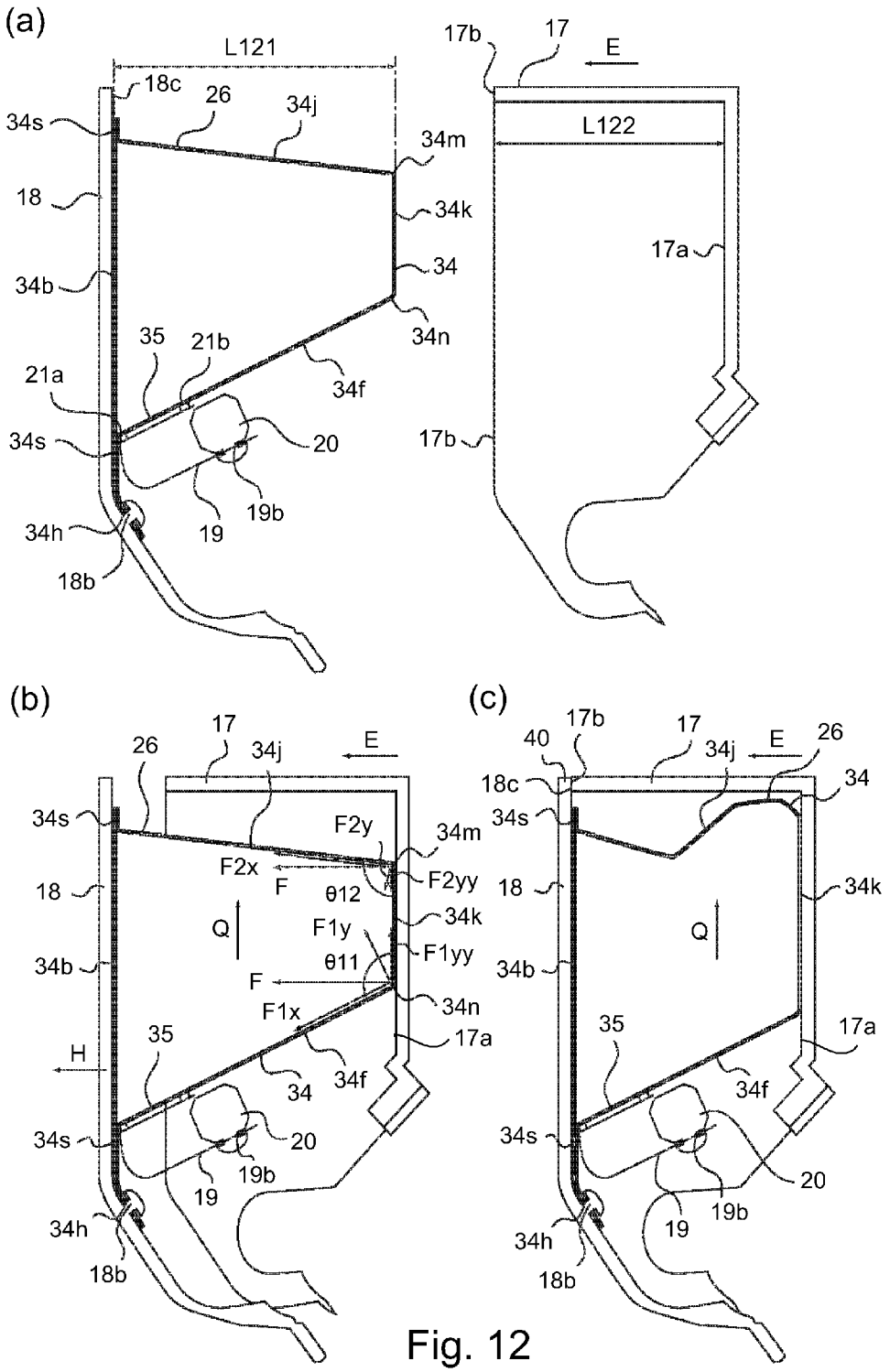

Parts (a), (b) and (c) of FIG. 12 are sectional views for illustrating a mounting process of a developer accommodating container into a first frame and a second frame.

Figure 13:
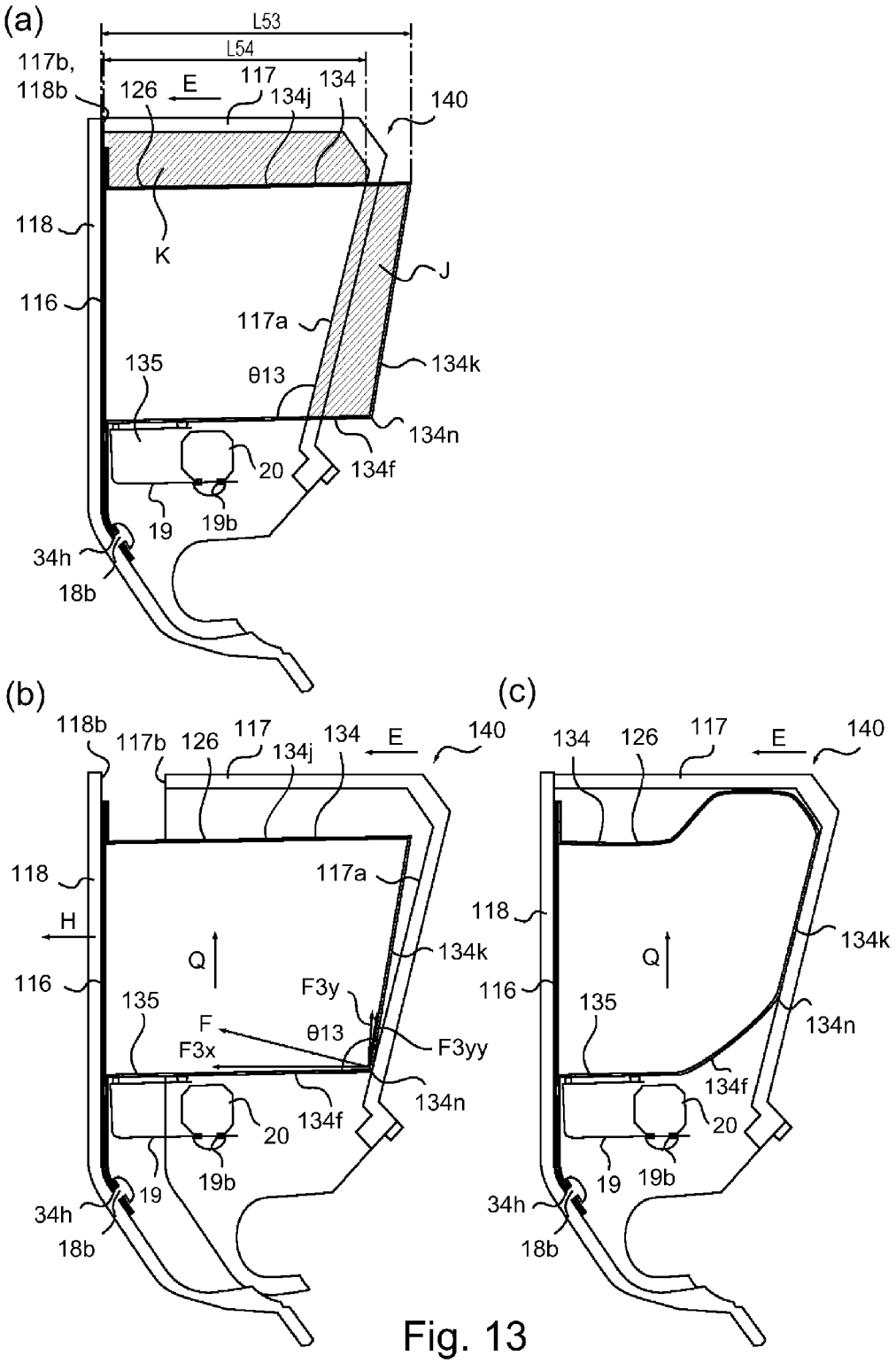

Parts (a), (b) and (c) of FIG. 13 are sectional views for illustrating a mounting process of a developer accommodating container into a first frame and a second frame.

DESCRIPTION OF THE PREFERRED EMBODIMENTS

With reference to the drawings, preferred embodiments of the present invention will be exemplarily described specifically below. However, dimensions, materials, shapes, functions and relative arrangements of constituent elements described in the following embodiments should be appropriately modified depending on constitutions and various conditions of an apparatus to which the present invention is applied, and therefore, the scope of the present invention is not limited to the following embodiments, unless otherwise specified. Further, in the following description, materials, shapes and the like of members which have already described are the same as those first described unless otherwise specified.

[Embodiment 1]

With reference to the drawings, a process cartridge and an image forming apparatus each including a developer accommodating unit in this embodiment will be described below as an example. Incidentally, in the following description, a longitudinal direction coincides with a direction of a long side of a box-shaped developer accommodating unit 25 or developing device 38 as shown in (b) of FIG. 4.

Figure 2:
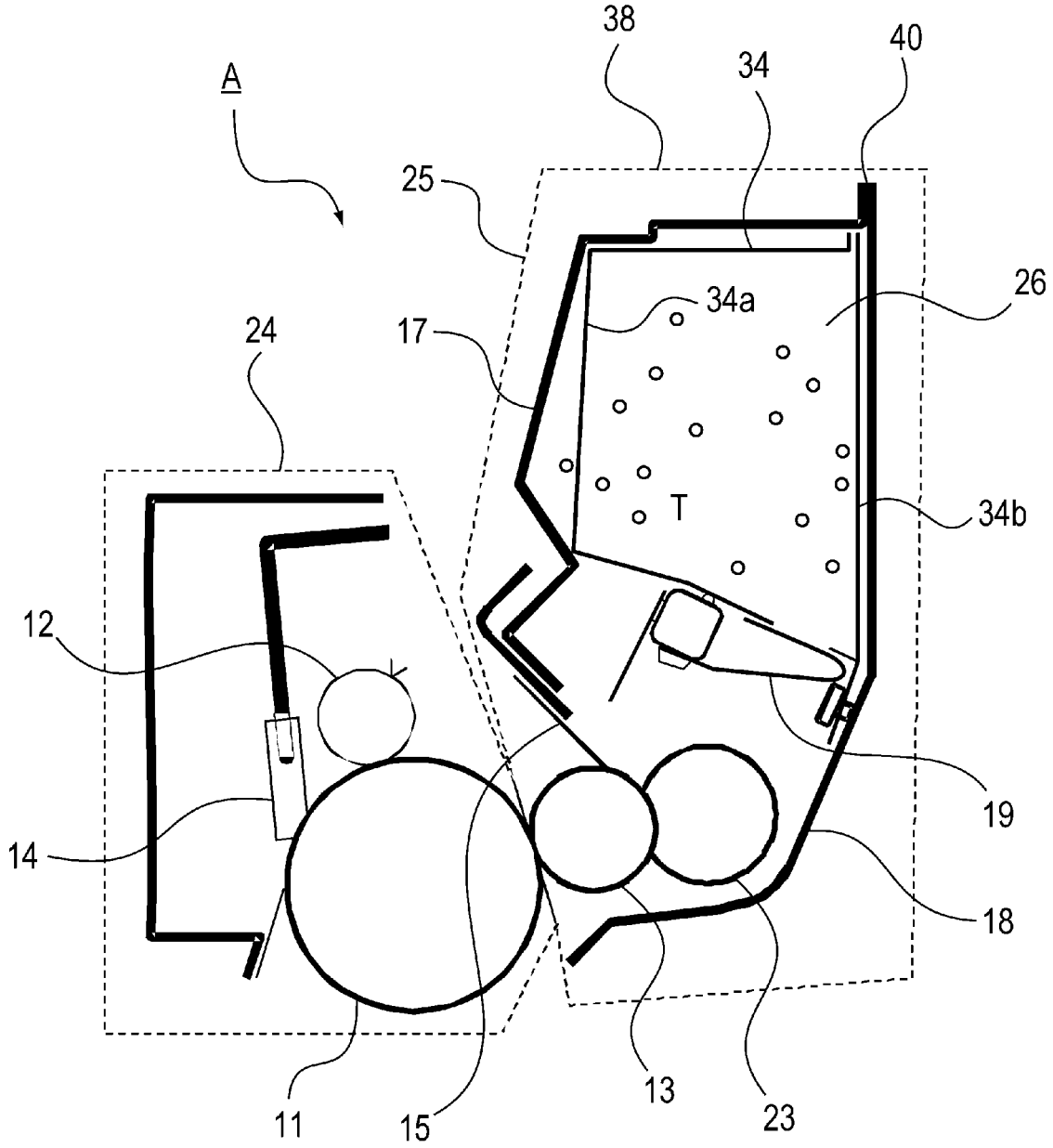
FIG. 2 is a principal sectional view of a process cartridge.
Figure 3:
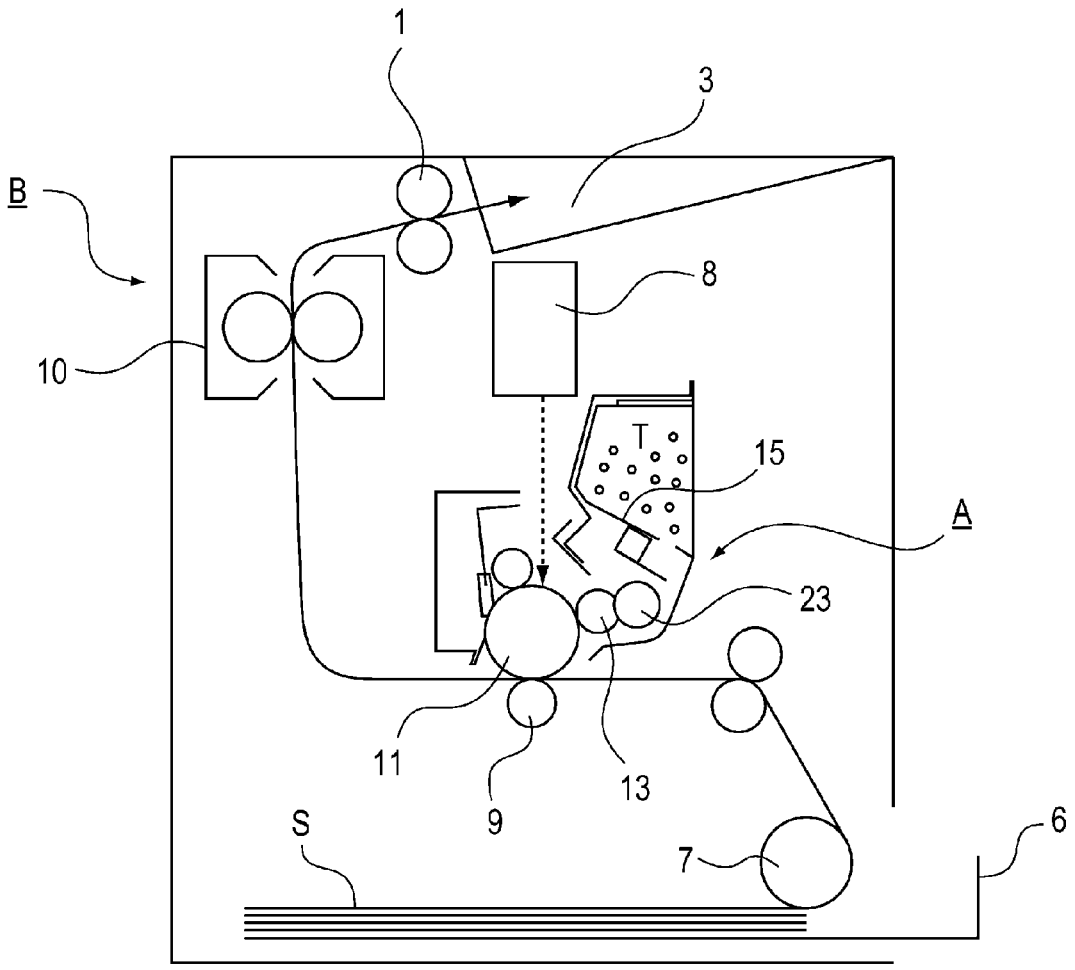
FIG. 3 is a principal sectional view of an image forming apparatus.

FIG. 2 is a principal sectional view of the process cartridge to which the present invention is applicable, and FIG. 3 is a principal sectional view of the image forming apparatus to which the present invention is applicable.

<Summary of Structure of Process Cartridge>

The process cartridge A includes, as shown in FIG. 2, a photosensitive drum 11 as an image bearing member and process means actable on the photosensitive drum 11. Here, as the process means, there are, e.g., a charging means for electrically charging a surface of the photosensitive drum 11, a developing device (developing means) 38 for forming an image on the photosensitive drum 11, and a cleaning means for removing a developer T (containing a toner, a carrier and the like) remaining on the surface of the photosensitive drum 11.

The process cartridge A in this embodiment integrally including a cleaner unit 24 and the developing device 38 as shown in FIG. 2, and is constituted so as to be detachably mountable to the image forming apparatus B as shown in FIG. 3. The cleaner unit 24 includes the photosensitive drum 11, and further includes, at a periphery of the photosensitive drum 11, a charging roller 12 as the charging means and a cleaning blade 14 as the cleaning means. Further, the developing device 38 as the developing means includes a frame 40 constituted by a first frame 17 and a second frame 18. The developing device 38 includes a developing roller 13 as a developer carrying member, a developing blade 15, a developer supplying roller 23, and the developer accommodating unit 25 described later. The developing roller 13 and the developing blade 15 are supported by the first frame 17.

<Summary of Structure of Image Forming Apparatus>

The process cartridge A is detachably mounted in the image forming apparatus B as shown in FIG. 3 and then is used for image formation. In the image formation, a sheet cassette 6 mounted at a lower portion of the image forming apparatus B feeds a sheet (recording material) S by a feeding roller 7 constituting a feeding means. In synchronism with this feeding of the sheet S, the photosensitive drum 11 is subjected to selective exposure to light from an exposure device 8, so that a latent image is formed. The developer T is supplied to the developing roller 13 (developer carrying member) by a sponge-like developer supplying roller 23, and then is carried in a thin layer on a surface of the developing roller 13 by the developing blade 15. By applying a developing bias (voltage) to the developing roller 13, the developer is supplied depending on the latent image, so that the latent image is developed into a developer image. This developer image is transferred onto the conveyed sheet S by bias voltage application to a transfer roller 9. The sheet S is conveyed to a fixing device 10, in which the developer image is fixed on the sheet S, and then the sheet S is discharged onto a discharge portion 3 at an upper portion of the image forming apparatus B by a discharging roller 1.

<Summary of Structure of Developer Accommodating Unit>

Next, a structure of a developer accommodating unit 25 will be described with reference to FIG. 1.

The developer accommodating unit 25 is, as shown in FIG. 2, constituted by a developer accommodating unit 26, the developing roller 13, the developing blade 15, and the first and second frames 17 and 18 for supporting these members. The first and second frames 17 and 18 constitute in combination the frame 40 for accommodating the developer accommodating container 20. The developer accommodating container 26 includes a developer accommodating member 34 as a flexible container for accommodating the developer T and a sealing member 19. The developer accommodating member 34 is accommodated in a space formed by mounting the first frame 17 to the second frame 18.

Incidentally, in this embodiment, the developer accommodating unit 25 is the same as the developing device 38. This is because the developer accommodating unit 25 includes the developing roller 13 and the developing blade 15. However, the developing roller 13 and the developing blade 15 may also be supported by a frame other than the frame for the developer accommodating unit 25, thus being separated from the developer accommodating unit 25. In this case, the developing device 38 is constituted by the developer accommodating unit 25, the developing roller 13 and the developing blade 25 (not shown).

<Summary of Structure of Developer Accommodating Container>

A structure of the developer accommodating container 26 will be described with reference to FIGS. 4, 5 and 6. Here, (a) of FIG. 4 is a sectional view of the developer accommodating unit 25 before the sealing member 19 is peeled off from the developer accommodating container 26, and (b) of FIG. 4 is a perspective view of the developer accommodating unit 25. FIG. 5 is a cut-away perspective view of the developer accommodating container 26. Part (a) of FIG. 6 is a perspective view of the developer accommodating container 26, and (b) of FIG. 6 is a sectional view of the developer accommodating container 26 taken along X-Y line of (a) of FIG. 6.

As shown in FIGS. 4 and 5, the developer accommodating container 26 is constituted by the developer accommodating member 34 as the flexible container and the sealing member 19 and is capable of accommodating the developer T therein. The developer accommodating member 34 is constituted by a molded portion 34*a* formed by molding a sheet-like material into a recessed shape by vacuum molding, air-pressure molding or press molding, and a sheet-like air-permeable portion 34*b* having air permeability. Here, a bonding method between the molded portion 34*a* and the air-permeable portion 34*b*, there are thermal welding, laser welding, adhesive bonding, adhesive tape bonding and the like.

Further, a degree of the air permeability of the air-permeable portion 34*b* may appropriately be selected, in view of a size (powder particle size) of the developer T, so as not to permit leakage of the developer T to the outside of the developer accommodating container 26. As a material for the air-permeable portion 34*b*, a nonwoven fabric formed of polyethylene terephthalate (PET), polyethylene (PE), polypropylene (PP) or the like in a thickness of 0.03-0.25 mm may preferably be used. Incidentally, the material for the air-permeable portion 34*b* is not limited to the nonwoven fabric but may also be a material provided with minute holes each smaller than the size of the powder such as the developer to be accommodated in the developer accommodating container 26.

At a part of an outer peripheral portion 34*c* of the developer accommodating member 34, holes 34*g* as a portion-to-be-fixed of the developer accommodating member 34 on the second frame 18 are provided. Further, the second frame 18 is provided with bosses 18*b* as a fixing portion for fixing the developer accommodating member 34 on the second frame 18. The developer accommodating container 26 is positioned relative to the second frame 18 by engaging the holes 34*g* of the developer accommodating member 34 with the bosses 18*b* of the second frame 18. Thereafter, the bosses 18*b* are melted by ultrasonic caulking, so that the developer accommodating container 26 is fixed to the second frame 18. As a fixing means, in addition to the ultrasonic caulking, it is also possible to use other means without using ultrasonic wave. For example, the fixing means may also be thermal caulking using heat, bonding using a solvent or an adhesive, insertion between the frames, hooking using a hole and a projection (boss or the like), etc.

Incidentally, a mounting method of the first frame 17 to the second developing roller 18 will be described later.

Further, the developer accommodating member 34 is provided with a discharging portion 35 as an opening for permitting discharge of the developer T. In order to prevent leaking-out of the developer T from the developer accommodating member 34 of the process cartridge A before use, the sealing member 19 is bonded to the developer accommodating member 34 so as to cover the discharging portion 35. The sealing member 19 is a flexible sheet-like member and is used for sealing the discharging portion 35. The sealing member 19 is peeled off from the developer accommodating member 34 to expose the discharging portion 35, and thus is capable of discharging the developer T from the developer accommodating member 34. Here, the holes 34*g* and the bosses 18*b* are provided in parallel to a longitudinal direction (long side direction) F of the developer accommodating member 34, and receive a force when the sealing member 19 is unsealed from the developer accommodating member 34.

Further, the sealing member 19 is connected with an unsealing member 20 at a portion-to-be-engaged 19*b*, and the unsealing member 20 is rotatably supported by the second frame 18. The unsealing member 20 is rotated in an arrow C direction by transmitting a driving force thereto by an unshown driving means provided in the image forming apparatus B, thus being capable of winding up the sealing member 19 to expose the discharging portion 35. Incidentally, herein a constitution in which the sealing member 19 is automatically unsealed is shown as an example, but the present invention is not limited thereto. For example, a manually unsealing constitution such that the sealing member is pulled out in the longitudinal direction to be unsealed may also be employed.

Here, the discharging portion 35 may desirably be configured so that the discharging portion 35 is in an attitude during image formation to permit easy discharge of the developer T. For that purpose, in this embodiment, in the attitude during the image formation, the discharging portion 35 is disposed vertically downward.

The structure of the developer accommodating container 26 will be specifically described with reference to FIG. 6. Part (a) of FIG. 6 is the perspective view of the developer accommodating container 26, and (b) of FIG. 6 is the X-X sectional view of (a) of FIG. 6.

As shown in (a) and (b) of FIG. 6, a top surface of the developer accommodating container 26 (at an upper portion in FIG. 6) is constituted by three sides consisting of a longitudinal end portion surface 26*a*, a longitudinal end portion surface 26*b* and a longitudinal central portion surface 26*c*. With respect to an mounting direction E, described later, of the first frame (not shown), distances from a surface 26*h*, as a surface where the developer accommodating container 26 opposes the second frame 18, to the longitudinal end portion surface 26*a*, the longitudinal end portion surface 26*b* and the longitudinal central portion surface 26*c* are taken as L1, L2 and L3, respectively. Then, L3<L1 and L3<L2 are satisfied.

That is, each of the distances L1 and L2 provides a largest portion between the surface opposing the first frame 17 and the surface opposing the second developing roller 18 with respect to the mounting direction of the developer accommodating container 26 at the longitudinal end portion. Further, the distance L3 provides a largest portion between the surface opposing the first frame 17 and the surface opposing the second frame 18 with respect to the mounting direction of the developer accommodating container 26 at the longitudinal central portion. In this case, L1 and L2 are larger than L3.

Further, each of a thickness t1 of an end surface 26*d* and a thickness t2 of an end surface 26*e* with respect to the longitudinal direction F of the developer accommodating container 26 is thinner than a thickness t3 of the end portion surface 26*a*, a thickness t4 of the end portion surface 26*b* and a thickness t5 of the central portion surface 26*c* with respect to a direction in which these portions are provided, crossing the mounting direction. That is, (t1<t3, t4, t5) and (t2<t3, t4, t5) are satisfied.

Further, the end surfaces 26*d* and 26*e* of the developer accommodating container 26 are inclined by angles θ1 and θ2, respectively, with respect to the mounting direction E of the first frame (not shown). Here, the angles θ1 and θ2 satisfy (0 degrees<θ1<90 degrees) and (0 degrees<θ2<90 degrees), respectively, and in this embodiment, θ1=3 degrees and θ2=3 degrees are set. The reason therefor will be described later.

<Mounting Method of Developer Accommodating Container to Frame)

Next, a mounting method of the developer accommodating container 26 to the frame 40 will be described with reference to FIG. 1. Parts (a) to (c) of FIG. 1 show a mounting process of the developer accommodating container 26 to the frame 40, and are sectional views of the developer accommodating unit 25 cut along the longitudinal direction F. Part (a) of FIG. 1 is the sectional view for illustrating a state in which the developer accommodating container 26 is fixed on the second frame 18. Part (b) of FIG. 1 is the sectional view for illustrating a state in which the first frame 17 is mounted partway to the second frame 18. Part (c) of FIG. 1 is the sectional view for illustrating a state after the first frame 17 is mounted to the second frame 18. Here, the developer accommodating container 26 in a first state before the first frame 17 is mounted to the second frame 18 is indicated by a chain double-dashed line.

Incidentally, the first state of the developer accommodating container 26 indicated by the chain double-dashed line is a state in which an external force is not applied to the longitudinal end portions. It can also be said that the first state is a natural state in which the external force is not applied. On the other hand, a state of the developer accommodating container 26 indicated by a solid line in (c) of FIG. 1 is a second state in which the longitudinal end portions are depressed (moved) toward the second frame 18, compared with the first state, with respect to the mounting direction E of the first frame 17 with the second frame 18.

Figure 1:
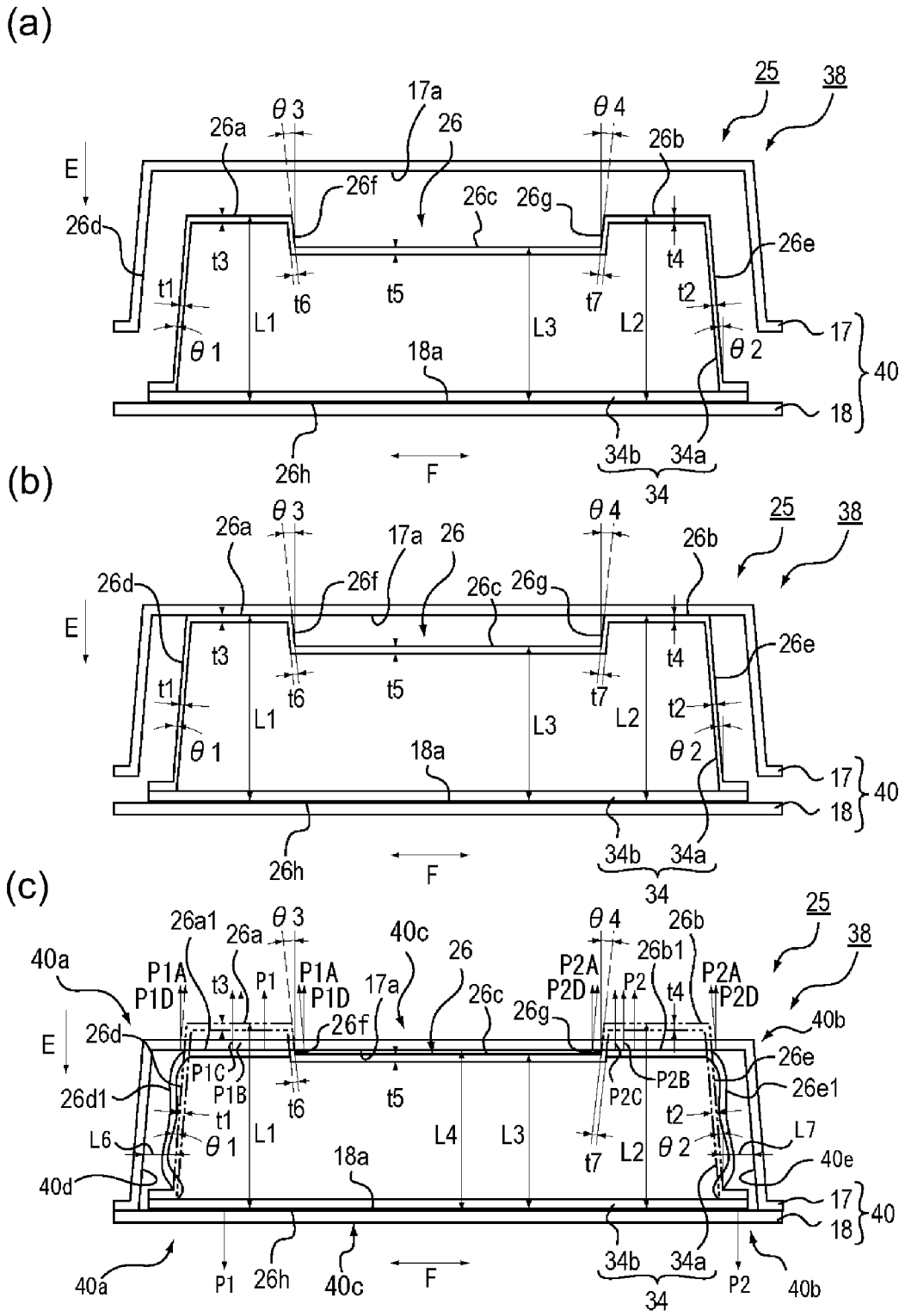

As shown in (a) of FIG. 1, by the above-described method, the developer accommodating container 26 is positioned and fixed relative to the second frame 18.

Next, as shown in (b) of FIG. 1, with the developer accommodating container 26 fixed as a unit on the second frame 18, the first frame 17 is mounted to respect to the mounting direction E. When the first frame 17 is mounted, first, an opposing surface 17*a* of the first frame 17 contacts the longitudinal end portion surfaces 26*a* and 26*b* of the developer accommodating container 26.

Next, as indicated by the chain double-dashed line in (c) of FIG. 1, (c) of FIG. 1 shows a state in which the first frame 17 is mounted to the second frame 18 in a predetermined position. Then, the longitudinal end portion surfaces 26*a* and 26*b* of the developer accommodating container 26 are placed in the second state in which these portions are depressed toward the second frame 18, compared with the first state free from the external force, relative to the opposing surface 17*a* of the first frame 17 with respect to the mounting direction E.

That is, when the first frame 17 is moved from the state of (b) of FIG. 1 in the mounting direction E, the developer accommodating container 26 has flexibility, and therefore the longitudinal end portion surfaces 26*a* and 26*b* of the developer accommodating container 26 are deformed and depressed in the mounting direction E by the opposing surface 17*a* of the first frame 17. At this time, in the case where an inside of the developer accommodating container 26 is filled with the developer T and the air, the air inside the developer accommodating container 26 comes out through the air-permeable portion 34*b*, so that the developer accommodating container 26 is deformed and depressed. Further, in the case the inside of the developer accommodating container 26 is filled with only the developer T, the end surfaces 26*d* and 26*e* as longitudinal end surfaces of the developer accommodating container 26 are flexed outward to move the developer T toward an outside with respect to the longitudinal direction F, so that the developer accommodating container 26 is deformed and depressed. This will be described specifically later.

Here, longitudinal end portion surfaces 26*a*1 and 26*a*2 of the developer accommodating container 26 in the second state in which the developer accommodating container 26 is deformed and depressed by the opposing surface 17*a* and thus is accommodated in the frame 40 are indicated by the solid line in (c) of FIG. 1. At this time, the distance from the surface 26*h* to the end portion surface 26*a* in the first state is L1 and the distance from the surface 26*h* to the end portion surface 26*b* in the first state is L2. Further, a distance between a surface 18*a* of the second frame opposing the surface 26*h* and the surface 17*a* of the first frame opposing the end portion surfaces 26*a* and 26*b* is taken as L4. In this case, L1 and L2 are larger than L4. That is, L4<L1 and L4<L2 are satisfied. Further, the distance L3 from the surface 26*h* to the central portion surface 26*c* is smaller than or equal to the distance L4. That is, L3≤L4 is satisfied.

For that reason, the frame 40 formed by the first frame 17 and the second frame 18 receives reaction forces P1 and P2 by depressing the developer accommodating container 26 at longitudinal end portion surfaces 40*a* and 40*b*, respectively. Incidentally, each of the reaction forces P1 and P2 is a resultant force of the following three forces. A first force is a force P1A (or P2A) for deforming the developer accommodating container 26 having the flexibility. A second force is a force P1B (or P2B) for letting the air, inside of the developer accommodating container 26, escape through the air-permeable portion 34*b* when the developer accommodating container 26 is depressed by the frame 40. A third force is a force P1C (or P2C) for pushing aside the developer inside of the developer accommodating container 26. The deforming forces P1A and P2A, the escaping forces P1B and P2B and the pushing-aside forces P1C and P2C are indicated only in one direction in (c) of FIG. 1, but are exerted also in an opposite direction of the arrows since the developer accommodating container has the flexibility.

Here, the frame 40 has a box-like shape extending in the longitudinal direction F as shown in (b) of FIG. 4. For this reason, as shown in FIG. 1, the end portion surfaces 40*a* and 40*b* are connected with the end surfaces 40*d* and 40*e*, respectively, formed in substantially parallel to the mounting direction E. For that reason, rigidity of each of the end portions 40*a* and 40*b* with respect to the mounting direction E is higher than rigidity of the central portion surface 40*c* with respect to the mounting direction E. Accordingly, with respect to the longitudinal direction (long side direction), the reaction force of the developer accommodating container 26 is not exerted on the frame 40 at the central portion surface 40*c* where the rigidity is low, but the reaction forces P1 and P2 of the developer accommodating container 26 are exerted on the frame 40 at the end portion surfaces 40*a* and 40*b*, respectively, so that it is possible to decrease a degree of the deformation of the frame 40.

Further, as described above, each of the thickness t1 of the end surface 26*d* and the thickness t2 of the end surface 26*e* of the developer accommodating container 26 is thinner than each of the thickness t3 of the end portion surface 26*a*, the thickness t4 of the end portion surface 26*b* and the thickness t5 of the central portion surface 26*c* of the developer accommodating container 26 provided along the direction crossing the mounting direction. For that reason, the end surfaces 26*d* and 26*e* of the developer accommodating container 26 are liable to cause buckling deformation with respect to the mounting direction E, so that the forces P1A and P2A for deforming the developer accommodating container 26 become small. Accordingly, the reaction forces P1 and P2 are smaller than those in the case where the developer accommodating container 26 is formed in a uniform thickness as a whole.

Here, during the mounting of the developer accommodating container 26 to the frame 40 and when the developer T is filled in the developer accommodating container 26, in order to maintain a shape of the developer accommodating container 26, the developer accommodating container 26 is required to have a certain thickness. However, a surface area of the end surfaces 26*d* and 26*e* is smaller than a surface area of the developer accommodating container 26 as whole, and therefore the influence on maintenance of the shape of the developer accommodating container 26 is small. For that reason, the thicknesses of the end surfaces 26*d* and 26*e* can be made thin.

Further, as described above, the end surfaces 26*d* and 26*c* of the developer accommodating container 26 are inclined by the angles θ1 and θ2, respectively, with respect to the mounting direction of the first frame 17 with the second frame 18. For that reason, the forces P1A and P2A for deforming the developer accommodating container 26 act as component forces P1D=P1A cos θ1 and P2D=P2A cos θ2, respectively, with respect to the mounting direction in which the reaction forces P1 and P2 are generated. Accordingly, the reaction forces P1 and P2 are smaller than those in the case where the end surfaces 26*a* and 26*e* are formed in parallel to the mounting direction E.

Incidentally, between the end surface 26*d* of the developer accommodating container 26 and the end surface 40*d* of the frame 40 and between the end surface 26*e* of the developer accommodating container 26 and the end surface 40*e* of the frame 40, spacings L6 and L7 are provided, respectively, with respect to the longitudinal direction F. For that reason, at projected portions 26*d*1 and 26*e*1 generated by flexure of the end surfaces 26*a* and 26*e* generated by the depression of the end portion surfaces 26*a* and 26*b*, the developer T moved by the depression of the end portion surfaces 26*a* and 26*b* can be accommodated. Here, the projected portions 26*d*1 and 26*e*1 of the developer accommodating container 26 in a state in which the developer accommodating container 26 is accommodated between the first frame 17 and the second frame 18 are indicated by the solid line in (c) of FIG. 1.

By the above-described constitution, even in the case where the developer accommodating container 26 including the depressed longitudinal end portions is accommodated in the frame 40, the degree of the deformation of the frame 40 by the reaction forces P1 and P2 of the developer accommodating container 26 can be decreased. For that reason, it is possible to decrease a degree of positional change of the process means such as the developing roller 13 to be mounted on the frame 40, so that the developing device 38 having a good image quality can be provided. Further, it is possible to provide the developer accommodating unit 25, the developing device 38, the process cartridge A and the image forming apparatus B which have a long lifetime without upsizing the frame 40 and by extension to the image forming apparatus B.

Incidentally, each of a thickness t6 of an inclined portion surface 26*f* between the end portion surface 26*a* and the central portion surface 26*c* and a thickness t7 of an inclined portion surface 26*g* between the end portion surface 26*b* and the central portion surface 26*c* may desirably be thinner than each of the thickness t3 of the end portion surface 26*a*, the thickness t4 of the end portion surface 26*b* and the thickness t5 of the central portion surface 26*c*. As a result, the developer accommodating container 26 easily causes the buckling deformation with respect to the mounting direction E, so that the forces P1A and P2A for deforming the developer accommodating container 26 become small.

Incidentally, the inclined portion surfaces 26*f* and 26*g* may desirably be inclined (e.g., with angles θ3 and θ4, respectively, shown in FIG. 1) with respect to the mounting direction E of the first frame (not shown) with the second frame (not shown). As a result, the forces P1A and P2A for deforming the developer accommodating container 26 act as component forces P1D=P1A cos θ3 and P2D=P2A cos θ4, respectively, with respect to the mounting direction in which the reaction forces P1 and P2 are generated. Accordingly, the reaction forces P1 and P2 are smaller than those in the case where the inclined portion surfaces 26*f* and 26*g* are formed in parallel to the mounting direction E.

Incidentally, in this embodiment, suppression of the deformation of the frame 40 by the reaction forces P1 and P2 when the first frame 17 was mounted to the second developing roller 18 was described. However, when the first frame 17 is mounted to the second frame 18, a similar effect can be obtained even in the case where the first frame 17 is mounted to the second frame 18 in a state (second state) in which the flexible developer accommodating container 26 is deformed and depressed in advance so as to be smaller in size than the frame 40. This is because even in the case where the flexible developer accommodating container 26 is deformed and depressed in advance so as to be smaller in size than the frame 40, the air flows into the inside of the developer accommodating container 26 through the air-permeable portion 34 after the first frame 17 is mounted to the second frame 18. Then, by the flow of the air into the inside of the developer accommodating container 26, a restoring force for restoring the shape of the developer accommodating container 26 to the original shape acts on the developer accommodating container 26. Accordingly, even in the case where the first frame 17 is mounted to the second frame 18 in the state in which the flexible developer accommodating container 26 is deformed and depressed in advance so as to be smaller in size than the frame 40, the reaction forces P1 and P2 of the developer accommodating container 26 are exerted on the first frame 17 and the second developing roller 18, respectively.

Incidentally, the depressing direction of the developer accommodating container 26 may be any direction if the depressing direction is substantially the same as the mounting direction of the first frame 17 with the second developing roller 18.

Incidentally, in this embodiment, an example in which the end surfaces 26*d* and 26*e* of the developer accommodating container 26 are deformed when the first frame 17 is mounted toward the second frame 18 was described. However, as shown in (a) and (b) of FIG. 10, when the first frame 17 is mounted toward the second frame 18, in addition to the deformation of the end surfaces 26*d* and 26*e* described above, it is also possible to deform an end surface 26*k*, of the developer accommodating container 26 with respect to a widthwise direction (short side direction) G, simultaneously with the deformation of the end surfaces 26*d* and 26*e*. The deformation of the end surface 26*k* with respect to the widthwise direction G will be described in an embodiment described later. Each of (a) and (b) of FIG. 10 is a perspective view for illustrating a state in which the developer accommodating container 26 is deformed. In each of (a) and (b) of FIG. 10, a state in which the end surface 26*k* with respect to the widthwise direction G and the end surfaces 26*d* and 26*e* with respect to the longitudinal direction F are deformed at the same time. By deforming the end surfaces 26*d*, 26*e* and 26*k* at the same time, compared with the case where either one of the widthwise end surface and the longitudinal end surface is deformed, it becomes possible to accommodate the developer accommodating container 26 in frames having various shapes.

<Embodiment 2>

Next, with reference to FIG. 7, a process cartridge and an image forming apparatus each including a developer accommodating unit in Embodiment 2 will be described as an example. Incidentally, in this embodiment, a constitution different from the constitution in Embodiment 1 described above will be described, and members having the same constitutions and functions as those in Embodiment 1 are represented by the same reference numerals or symbols as those in Embodiment 1 for the purpose of explanation thereof.

Parts (a) to (c) of FIG. 7 show an mounting process of a developer accommodating container 126 to a frame 140, and are sectional views of the developer accommodating unit 125 cut along the longitudinal direction F in this embodiment. Part (a) of FIG. 7 is the sectional view for illustrating a state in which the developer accommodating container 126 is fixed on a second frame 118. Part (b) of FIG. 7 is the sectional view for illustrating a state in which a first frame 117 is mounted partway to the second frame 118. Part (c) of FIG. 7 is the sectional view for illustrating a state after the first frame 117 is mounted to the second frame 118. Here, the developer accommodating container 126 in a first state before the first frame 117 is mounted to the second frame 118 is indicated by a chain double-dashed line.

Incidentally, the first state of the developer accommodating container 126 indicated by the chain double-dashed line shown in (c) of FIG. 7 is a state in which an external force is not applied to the longitudinal end portions. On the other hand, a state of the developer accommodating container 126 indicated by a solid line in (c) of FIG. 7 is a second state in which the longitudinal end portions are depressed (moved)

toward the second frame 118, compared with the first state, with respect to the mounting direction E of the first frame 117 with the second frame 118.

As shown in (a) of FIG. 7, the developer accommodating member 134 in this embodiment is constituted by a first molded portion 134*a* and a second molded portion 234*b* which are formed by injection molding or molding of a sheet-like material by vacuum molding, air-pressure molding or press molding. That is, in Embodiment 1, the developer accommodating member 34 was constituted by the molded portion 34*a* and the air-permeable portion 34*b*, but in this embodiment, in place of the air-permeable portion 34*b*, the second molded portion 134*b* which is not air-permeable is used. Accordingly, the developer accommodating member 135 does not permit air permeation from the inside to the outside thereof. Here, as a bonding method between the first and second molded portions 134*a* and 134*b*, there are thermal welding, laser welding, adhesive bonding, adhesive tape bonding, and the like.

A fixing method of the developer accommodating container 126 to the second frame 118 is the same as that in Embodiment 1.

Next, as shown in (b) of FIG. 7, when the first frame 117 is mounted to the developer accommodating container 126 fixed as a unit on the second frame 118, first, the longitudinal end portion surfaces 126*a* and 126*b* of the developer accommodating container 126 contacts an opposing surface 117*a* of the first frame 117.

Next, as indicated by the chain double-dashed line in (c) of FIG. 7, (c) of FIG. 7 shows a state in which the first frame 117 is mounted to the second frame 118 in a predetermined position. In this case, the longitudinal end portion surfaces 126*a* and 126*b* of the developer accommodating container 126 are depressed toward the second frame 118, compared with the first state free from the external force, relative to the opposing surface 117*a* of the first frame 117 with respect to the mounting direction E.

That is, when the first frame 117 is moved from the state of (b) of FIG. 7 in the mounting direction E, the developer accommodating container 126 has flexibility, and therefore the longitudinal end portion surfaces 126*a* and 126*b* of the developer accommodating container 126 are deformed and depressed in the mounting direction E by the opposing surface 117*a* of the first frame 117. At this time, the longitudinal end surfaces 126*d* and 126*e* of the developer accommodating container 126 are flexed outward, so that the developer accommodating container 26 is deformed and depressed. This will be described specifically later.

Here, longitudinal end portion surfaces 126*a*1 and 126*a*2 of the developer accommodating container 126 in the second state in which the developer accommodating container 126 is deformed and depressed by the opposing surface 117*a* and thus is accommodated in the frame 140 are indicated by the solid line in (c) of FIG. 7. At this time, the distance from the surface 126*h* to the end portion surface 126*a* is L11 and the distance from the surface 126*h* to the end portion surface 126*b* is L12. Further, a distance between a surface 118*a* of the second frame 118 opposing the surface 126*h* and the surface 117*a* of the first frame 117 opposing the end portion surfaces 126*a* and 126*b* is taken as L14. In this case, L11 and L12 are larger than L14. That is, L14<L11 and L14<L12 are satisfied. Further, the distance L13 from the surface 126*h* to the central portion surface 126*c* is smaller than or equal to the distance L14. That is, L13≤L14 is satisfied.

For that reason, the frame 140 formed by the first frame 117 and the second frame 118 receives reaction forces P11 and P12 by depressing the developer accommodating container 126 at longitudinal end portion surfaces 140*a* and 140*b*, respectively. Incidentally, each of the reaction forces P11 and P12 is a resultant force of a force P1A (or P2A) for deforming the developer accommodating container 126 having the flexibility and a force P1C (or P2C) for pushing aside the developer inside of the developer accommodating container 126.

Here, the frame 140 has a box-like shape extending in the longitudinal direction F as shown in (b) of FIG. 4. For this reason, as shown in FIG. 7, the end portion surfaces 140*a* and 140*b* are connected with the end surfaces 140*d* and 140*e*, respectively, formed in substantially parallel to the mounting direction E. For that reason, rigidity of each of the end portions 140*a* and 140*b* with respect to the mounting direction E is higher than rigidity of the central portion surface 140*c* with respect to the mounting direction E. Accordingly, with respect to the longitudinal direction (long side direction), the reaction force of the developer accommodating container 126 is not exerted on the frame 140 at the central portion surface 140*c* where the rigidity is low, but the reaction forces P11 and P12 of the developer accommodating container 126 are exerted on the frame 140 at the end portion surfaces 140*a* and 140*b*, respectively, so that it is possible to decrease a degree of the deformation of the frame 140.

Further, as described above, each of the thickness t11 of the end surface 126*d* and the thickness t12 of the end surface 126*e* of the developer accommodating container 126 is thinner than each of the thickness t13 of the end portion surface 126*a*, the thickness t14 of the end portion surface 126*b* and the thickness t15 of the central portion surface 126*c* of the developer accommodating container 126 provided along the direction crossing the mounting direction. For that reason, the end surfaces 126*d* and 126*e* of the developer accommodating container 126 are liable to cause buckling deformation with respect to the mounting direction E, so that the forces for deforming the developer accommodating container 126 become small. Accordingly, the reaction forces P11 and P12 are smaller than those in the case where the developer accommodating container 126 is formed in a uniform thickness as a whole.

Incidentally, between the end surface 126*d* of the developer accommodating container 126 and the end surface 140*d* of the frame 140 and between the end surface 126*e* of the developer accommodating container 126 and the end surface 140*e* of the frame 140, spacings L16 and L17 are provided, respectively, with respect to the longitudinal direction F. As described above, the developer accommodating container 126 does not permit the air permeation from the inside to the outside, and therefore when the developer accommodating container 126 is depressed by the frame 140, an inside volume of the developer accommodating container 126 is not changed. For that reason, the volume of the developer accommodating container 126 decreased due to a difference between the height L14 and each of the heights L11 and L12 is complemented by expansion of projected portions 126*d*1 and 126*e*1 of the developer accommodating container 126 into spacings L16 and L17, respectively. Further, also by movement of the developer T, the projected portions 126*d*1 and 126*e*1 expand into the spacings L16 and L17, respectively. As a result, the developer accommodating container 126 molded in larger size than the frame 140 can be accommodated between the first frame 117 and the second frame 118. Here, the projected portions 126*d*1 and 126*e*1 of the developer accommodating container 126 in a state in which the developer accommodating container 126 is accommodated between the first frame 117 and the second frame 118 are indicated by the solid line in (c) of FIG. 7.

By the above-described constitution, even in the case where the developer accommodating container 126 including the depressed longitudinal end portions is accommodated in the frame 140, the degree of the deformation of the frame 140 by the reaction forces P11 and P12 of the developer accommodating container 126 can be decreased. For that reason, it is possible to decrease a degree of positional change of the process means such as the developing roller 13 to be mounted on the frame 140, so that the developing device 138 having a good image quality can be provided. Further, it is possible to provide the developer accommodating unit 125, the developing device 138, and the like which have a long lifetime without upsizing the frame 140.

<Embodiment 3 >

Next, with reference to FIG. 8, a process cartridge and an image forming apparatus each including a developer accommodating unit in Embodiment 3 will be described as an example. Incidentally, in this embodiment, a constitution different from the constitution in the embodiments described above will be described, and members having the same constitutions and functions as those in Embodiment 1 are represented by the same reference numerals or symbols as those in the above-described embodiments for the purpose of explanation thereof.

Parts (a) to (c) of FIG. 8 show an mounting process of a developer accommodating container 226 to a frame 240, and are sectional views of the developer accommodating unit 225 cut along the longitudinal direction F in this embodiment. Part (a) of FIG. 8 is the sectional view for illustrating a state in which the developer accommodating container 226 is fixed on a second frame 218. Part (b) of FIG. 8 is the sectional view for illustrating a state in which a first frame 217 is mounted partway to the second frame 218. Part (c) of FIG. 8 is the sectional view for illustrating a state after the first frame 217 is mounted to the second frame 218. Here, the developer accommodating container 226 in a first state before the first frame 217 is mounted to the second frame 218 is indicated by a chain double-dashed line.

Incidentally, the first state of the developer accommodating container 226 indicated by the chain double-dashed line shown in (c) of FIG. 8 is a state in which an external force is not applied to the longitudinal end portions. On the other hand, a state of the developer accommodating container 226 indicated by a solid line in (c) of FIG. 8 is a second state in which the longitudinal end portions are depressed (moved) toward the second frame 218, compared with the first state, with respect to the mounting direction E of the first frame 217 with the second frame 218.

As shown in (a) of FIG. 8, the developer accommodating member 234 in this embodiment is constituted by a molded portion 234*a* and an air-permeable portion 234*b*.

A fixing method of the developer accommodating container 226 to the second frame 218 is the same as that in Embodiment 1.

Next, as shown in (b) of FIG. 8, when the first frame 217 is mounted to the developer accommodating container 226 fixed as a unit on the second frame 218, first, a surface 226*a* of the developer accommodating container 226 contacts opposing end portion surfaces 217*a* and 217*b* of the first frame 217 with respect to the longitudinal direction F.

Next, as indicated by the chain double-dashed line in (c) of FIG. 8, (c) of FIG. 8 shows a state in which the first frame 217 is mounted to the second frame 218 in a predetermined position. In this case, the longitudinal end portion of the developer accommodating container 226 are placed in the second state in which these portions are depressed toward the second frame 218, compared with the first state free from the external force, relative to the opposing end portion surfaces 217*a* and 217*b* of the first frame 217 with respect to the mounting direction E.

That is, when the first frame 217 is moved from the state of (b) of FIG. 8 in the mounting direction E, the developer accommodating container 226 has flexibility, and therefore the longitudinal end portions of the developer accommodating container 226 with respect to the longitudinal direction F are deformed and depressed in the mounting direction E by the opposing end portion surfaces 217*a* and 217*b* of the first frame 217. At this time, in the case where the inside of the developer accommodating container 226 is filled with the developer and the air, the air inside the developer accommodating container 226 comes out through the air-permeable portion 234*b*, so that the developer accommodating container 226 is deformed and depressed. Further, in the case where the inside of the developer accommodating container 226 is filled with only the developer T, the longitudinal end surfaces 226*d* and 226*e* as longitudinal end surfaces of the developer accommodating container 226 are flexed outward, to move the developer T toward an outside with respect to the longitudinal direction F, so that the developer accommodating container 226 is deformed and depressed.

Here, a surface 226*a*1 of the developer accommodating container 226 in the state in which the developer accommodating container 226 is deformed and depressed by the opposing end portion surfaces 217*a* and 217*b* is indicated by the solid line in (c) of FIG. 8. At this time, a distance from the surface 226*h* to the surface 226*a* is L21, a distance between the surface 218*a* of the second frame 218 opposing the surface 226*h* and the end portion surface 217*a* of the first frame 217 opposing the surface 226*a* is L22, and a distance between the surface 218*a* of the second frame 218 opposing the surface 226*h* and the end portion surface 217*b* of the first frame 217 opposing the surface 226*a* is L23. In this case, L21 is larger than L22 and L23. That is, L24<L21 and L23<L21 are satisfied. Further, the distance L24 from the surface 218*a* to the central portion surface 217*c* is smaller than or equal to the distance L21. That is, L21≤L24 is satisfied.

For that reason, the frame 240 formed by the first frame 217 and the second frame 218 receives reaction forces P21 and P22 by depressing the developer accommodating container 226 at longitudinal end portion surfaces 240*a* and 240*b*, respectively.

Here, the frame 240 has a box-like shape extending in the longitudinal direction F as shown in (b) of FIG. 4, so that the end portion surfaces 240*a* and 240*b* are connected with the end surfaces 240*d* and 240*e*, respectively, formed in substantially parallel to the mounting direction E. For that reason, rigidity of each of the end portions 240*a* and 240*b* with respect to the mounting direction E is higher than rigidity of the central portion surface 240*c* with respect to the mounting direction E. Accordingly, with respect to the longitudinal direction (long side direction), the reaction force of the developer accommodating container 226 is not exerted on the frame 240 at the central portion surface 240*c* where the rigidity is low. On the other hand, the reaction forces P21 and P22 of the developer accommodating container 226 are exerted on the frame 240 at the end portion surfaces 240*a* and 240*b*, respectively, so that it is possible to decrease a degree of the deformation of the frame 240.

By the above-described constitution, even in the case where the developer accommodating container 226 including the depressed longitudinal end portions is accommodated in the frame 240, the degree of the deformation of the frame 240 by the reaction forces P21 and P22 of the developer accommodating container 226 can be decreased. For that reason, it is possible to decrease a degree of positional change of the process means such as the developing roller 13 to be mounted on the frame 240, so that the developing device 238 having a good image quality can be provided. Further, it is possible to provide the developer accommodating unit 225, the developing device 238, and the like which have a long lifetime without upsizing the frame 240.

Incidentally, in the above-described embodiments, the process cartridge integrally including the photosensitive drum and, as the process means, the charging means, the developing means and the cleaning means was illustrated as the process cartridge capable of being detachably mountable to the image forming apparatus. However, the process cartridge is not limited thereto but may also be a cartridge integrally including the developer carrying member and a developer unit in addition to the photosensitive drum. Further, the process cartridge may also be a process cartridge integrally including any one of the charging means and the cleaning means in addition to the photosensitive drum.

<Embodiment 4>

The embodiment, described at the final portion of Embodiment 1, in which the end surface of the developer accommodating container 26 with respect to the widthwise direction is deformed will be specifically described.

(Relationship Between Shape of Developer Accommodating Container and Shape of Frame)

A relationship between the shape of the developer accommodating container 26 before being accommodated between the first and second frames 17 and 18 and the shape of the frame 40 including the first and second frames 17 and 18 for accommodating the developer accommodating container 26 will be described.

As shown in FIG. 11, the case of a constitution in which the top surface 17*a* (contact surface) of the first frame 17 and the top surface 34*a* (third surface) are parallel to each other and in which the top surface 17*a* is perpendicular to the mounting direction E of the first frame 17 with the second frame 18 will be described. Further, the mounting direction E of the first frame 17 with the second frame 18 is a direction perpendicular to connecting sides 17*b* and 18*c* of the first frame 17 and the second frame 18, respectively ((a) of FIG. 12).

As shown in FIG. 11, the developer accommodating container 26 is larger than the frame 40 (as indicated by a hatched portion J in FIG. 11) with respect to the direction perpendicular to the connecting sides 17*b* and 18*c* of the first and second frames 17 and 18 (i.e., with respect to the same direction as the mounting direction E).

Incidentally, details of the mounting method of the first frame 17 to the second frame 18 will be described later as a mounting method of the developer accommodating container 26 into the frame 40.

Specifically, when a width of another configuration of the developer accommodating container 26 in an arbitrary position with respect to the direction perpendicular to the connecting sides 17*b* and 18*c* is a length L121 and a distance of an inner wall of the frame 40 in a position corresponding to the length L121 is a length L122, a relationship of (length L121)>(length L122) is satisfied.

Further, the developer accommodating member 34 is molded by changing angles of the surface 34*f* (first surface) including the opening 35 and the surface 34*g* (second surface) opposing the surface 34*f* with respect to the top surface 34*k* so that the sides 34*f* and 24*g* of the developer accommodating member 34 satisfy the following relationship. Here, the top surface 17*a* of the first frame 17 is a surface where the first frame 17 first contacts the developer accommodating member 34 during mounting.

With respect to the mounting direction, when an interior angle formed between the top surface 17*a* and the surface 34*f* is an angle θ11 and an interior angle formed between the top surface 17*a* and the surface 34*j* is an angle θ12, a relationship of (angle θ11)>(angle θ12) is satisfied.

(Mounting Method of Developer Accommodating Container into Frame)

The mounting method of the developer accommodating container 26 into the frame 40 will be described.

Parts (a), (b) and (c) of FIG. 12 are sectional views sequentially showing the mounting method of the developer accommodating container 26 into the frame 40. Part (a) of FIG. 12 is the sectional view in which the developer accommodating container 26 is fixed on the second frame 18, and (b) of FIG. 12 is the sectional view of a mounting process of the first frame 17 to the second frame 18 on which the developer accommodating container 26 is fixed. Further, (c) of FIG. 12 is the sectional view showing a state in which the second frame 18 and the first frame 17 are connected to each other to form the frame 40 and the developer accommodating container 26 is accommodated between the second frame 18 and the first frame 17.

[Fixing of Developer Accommodating Container on Second Frame]

First, as shown in (a) of FIG. 12, the developer accommodating container 25 is fixed on the second frame 18 by engaging the bosses 18*f* of the second frame 18 with the holes 34*b* of the developer accommodating member 34. In this embodiment, the engagement is made by ultrasonic caulking, but a fixing method may also be a method other than the ultrasonic caulking if the developer accommodating member 34 can be fixed on the second frame 18. For example, it is possible to use thermal caulking using heat, bonding using a solvent or an adhesive, insertion between frames, hooking of the holes on projections of the bosses etc., and the like.

[Mounting of First Frame to Second Frame]

Next, with the second frame 18 on which the developer accommodating container 26 is fixed, the first frame 17 is mounted to respect to the direction E shown in (b) of FIG. 12. At this time, with respect to the mounting direction E, the developer accommodating container 26 is larger than the frame 40 constituted by the first frame 17 and the second frame 18 (as indicated by the hatched portion J in FIG. 11).

Therefore, when the first frame 17 is mounted to the second frame 18, the top surface 17*a* of the first frame 17 first contacts the top surface 34*k* of the developer accommodating member 34. The top surface 34*k* is a surface crossing both of the surface 34*f* including the opening 35 of the developer accommodating member 34 and the surface 34*j* opposing the surface 34*f* of the developer accommodating member 34. That is, the top surface 34*k* of the developer accommodating member 34 is a contact portion where the developer accommodating member 34 contacts the top surface 17*a* of the first frame 17.

Further, the developer accommodating container 26 has the flexibility, and therefore the developer accommodating container 26 is depressed and deformed in the mounting direction E by the top surface 17*a* of the first frame 17. At this time, the inside air is evacuated through the air-permeable portion 34*b* of the developer accommodating container 26 with respect to an arrow H direction of (b) of FIG. 12, so that a developer 39 inside the developer accommodating container 26 is compressed with a high density. As a result, the developer accommodating container 26 molded so as to be larger than the frame 40 is accommodated between the first and second frames 17 and 18.

Here, a relationship of forces exerted from the top surface 17*a* of the first frame 17 to the surface 34*f* including the opening 35 of the developer accommodating member 34 and forces exerted from the top surface 17*a* of the first frame 17 to the surface 34*j* opposing the surface 34*f* of the developer accommodating member 34 is shown below.

As shown in (b) of FIG. 12, when the top surface 17*a* f the first frame 17 contacts the top surface 34*k* of the developer accommodating member 34, a force in an arrow F direction perpendicular to the top surface 17*a* acts on each of a bent portion 34*m* connecting the top surface 34*k* and the surface 34*j* and a bent portion 34*n* connecting the top surface 34*k* and the surface 34*f*. Here, each of the bent portions 34*m* and 34*n* is a contact portion with the top surface 17*a* of the first frame 17. Therefore, the forces exerted on the sides 34*f* and 34*j* of the developer accommodating member 34 can be represented by the following formulas, respectively, by using the above-described angles θ11 and θ12.

[Forces Exerted on Bent Portions]

On the bent portion 34*n*, the following forces are exerted.

Force component parallel to surface 34*f* including opening 35: F1*x*

$$F1x=F\times\cos|\theta 11-90°|$$

Force component perpendicular to surface 34*f* including opening 35: F1*y*

$$F1y=F\times\sin|\theta 11-90°|$$

Force component parallel to top surface 17*a* of the first frame 17: F1*yy*

$$F1yy=F\times\sin|\theta 11-90°|\times\cos|\theta 11-90°|$$

Here, sin θ×cos θ=(sin 2θ)/2, and therefore, $$F1yy=F\times(\sin(2\theta|\theta 11-90°|))/2.$$

On the other hand, on the bent portion 34*m*, the following forces are exerted.

Force component parallel to surface 34*j*: F2*x*

$$F2x=F\times\cos|\theta 12-90°|$$

Force component perpendicular to surface 34*j*: F2*y*

$$F2y=F\times\sin|\theta 12-90°|$$

Force component parallel to top surface 17*a* of first frame 17: F2*yy*

$$\begin{aligned}F2yy &= F\times\sin|\theta 12-90°|\times\cos|\theta 12-90°|\\ &= F\times(\sin(2\times|\theta 12-90°|))/2\end{aligned}$$

Here, the force F1*x* is a force component for bending the surface 34*f* of the developer accommodating member 34 (for forming a crease), and the force F2*x* is a force component for bending the surface 34*j* of the developer accommodating member 34 (for forming a crease). A large force component shows that the surface is liable to be bent. Further, the force F1*yy* is force component for causing the surface 34 of the developer accommodating member 34 to fall, and the force F2*yy* is a force component for causing the surface 34*j* of the developer accommodating member 34 to fall. A larger force component shows that the surface is liable to fall.

Here, by satisfying a relationship of (angle θ11)>(angle θ12), (force F1*x*)<(force F2*x*) and (force F1*yy*)>(force F2*yy*) are satisfied.

For this reason, when the developer accommodating container 26 is deformed and depressed in the direction E by the top surface 17*a* of the first frame 17, based on the force relationship of F1*x*<F2*x*, the surface 34*j* opposing the surface 34*f* including the opening 35 is positively bent rather than the surface 34*f* including the opening 35 of the developer accommodating member 34.

Further, based on the force relationship of F1*yy*>F2*yy*, the bent portions 34*m* and 34*n* of the developer accommodating member 34 are moved in an arrow Q direction. Further, the surface 34*f* including the opening 35 positively falls toward the inside of the developer accommodating member 34 (in the arrow Q direction of (b) of FIG. 12).

Therefore, the bent portion 34*n* of the developer accommodating container 26 is moved in the arrow Q direction, so that the force F1*x* exerted on the surface 34*f* including the opening 35 is released. As a result, it becomes possible to accommodate the developer accommodating container 26 between the first and second frames 17 and 18 while preventing folding and crease at the surface 34*f*.

For this reason, the folding and crease at the opening can be prevented without particularly providing a mechanism for expanding the opening by a leaf spring or the like in the neighborhood of the opening, so that it becomes possible to satisfactorily discharge the developer from the developer accommodating container at a low cost.

Incidentally, the surface 34*j* of the developer accommodating container 26 is caused to fall toward an outside of the developer accommodating container 26, so that a part of the developer accommodating container 26 is accommodated in a space above the developer accommodating container 26.

Further, it becomes possible to prevent the deformation of the opening 35 by preventing the surface 34*f* including the opening 35 from generating the folding and crease, so that it is possible to stably supply the developer 39.

From the above, as shown in (c) of FIG. 12, the developer accommodating container 26 is molded so as to be larger than the frame 40, but can be accommodated between the first and second frames 17 and 18, so that it becomes possible to efficiently accommodate the developer.

Incidentally, in this embodiment, the developing device 38 as a unit prepared by integrally mounting the developing roller 13, the developing blade 15 and the developer accommodating container 26 was described, but the present invention is not limited thereto. For example, it is also possible to employ a constitution in which the developing device 38 including the developing blade 15 and the frame 40 and the developer accommodating unit 25 including the developer accommodating container 26 are mounted as separate members in the image forming apparatus.

<Embodiment 5>

In this embodiment, a constitution different from the constitution in Embodiment 4 with respect to the shape relationship between the developer accommodating container and the developing device is employed.

In this embodiment, different from Embodiment 4, the case of a constitution in which the top surface 17*a* of the first frame 17 is not parallel to the top surface 34*k* of the developer accommodating member 34 and is not perpendicular to the mounting direction E will be described.

Incidentally, identical and similar portions to those in Embodiment 1 are represented by the same reference numerals or symbols and will be omitted from redundant description.

(Relationship Between Shape of Developer Accommodating Container and Shape of Frame)

A relationship between the shape of the developer accommodating container 126 before being accommodated between the first and second frames 117 and 118 and the shape of the frame 140, including the first and second frames 117 and 118, for accommodating the developer accommodating container 126 will be described.

Parts (a), (b) and (c) of FIG. 13 are sectional views sequentially showing a mounting method of the developer accommodating container 126 into the frame 140. Further, (a) of FIG. 13 is the sectional view showing a relationship between the shape of the developer accommodating container 126 before being accommodated between the first and second frames 17 and 18 and the shape of the frame 140 prepared by connecting the first and second frames 17 and 18. Incidentally, the mounting direction E of the first frame 117 with the second frame 118 is, similarly as in Embodiment 4, a direction perpendicular to connecting sides 117*b* and 118*b* of the first frame 117 and the second frame 118, respectively ((a) and (b) of FIG. 13).

As shown in (a) of FIG. 13, the developer accommodating container 126 is, similarly as in Embodiment 1, larger than the frame 140 with respect to the direction perpendicular to the connecting sides 117*b* and 118*b* of the first and second frames 117 and 118.

Incidentally, details of the mounting method of the first frame 117 with the second frame 118 will be described later as a mounting method of the developer accommodating container 126 into the frame 140.

Here, a width of another configuration of the developer accommodating container 126 in an arbitrary position with respect to the direction perpendicular to the connecting sides 117*b* and 118*b* is a length L53. Further, a distance of an inner wall of the frame 140 in a position corresponding to the length L53 is a length L54. Then, a relationship such that (length L53)>(length L54) is satisfied is provided.

Further, in this embodiment, a top surface 117*a* (contact side) of the first frame 117 first contacting the developer accommodating member 134 of the developer accommodating container 126 during the mounting is characterized by satisfying the following relationship.

That is, when an interior angle formed between the top surface 117*a* of the first frame 117 and a surface 134*f* (first surface) including the opening 135 of the developer accommodating member 134 is an angle θ13, the top surface 117*a* is inclined so as to satisfy a relationship of 90°<(angle 3)<180°. Further, a space in which the depressed developer accommodating container 126 is to be accommodated when the first and second frames 117 and 118 are connected with each other (as indicated by a hatched line K of (a) of FIG. 13). That is, a surface 134*j* (second surface) of the developer accommodating container 126 falls into the hatched portion K, so that a part of the developer accommodating container.

(Mounting Method of Developer Accommodating Container into Frame)

The mounting method of the developer accommodating container 126 into the frame 140 will be described. Part (b) of FIG. 13 is the sectional view showing a state of a depressing process of the developer accommodating member 134 of the developer accommodating container 126 by the first frame 118. Further, (c) of FIG. 13 is the sectional view showing a state in which the second frame 118 and the first frame 117 are connected to each other to form the frame 140 and the developer accommodating container 126 is accommodated between the second frame 118 and the first frame 117.

[Mounting of First Frame to Second Frame]

Next, with the second frame 118 on which the developer accommodating container 126 is fixed, the first frame 117 is mounted to respect to the direction E shown in (b) of FIG. 13. At this time, with respect to the mounting direction E, the developer accommodating container 126 is larger than the frame 40 constituted by the first frame 117 and the second frame 118 (as indicated by a hatched portion J in (a) of FIG. 13).

Therefore, when the first frame 117 is mounted to the second frame 118, the top surface 117*a* of the first frame 117 first contacts the bent portion 134*n*. That is, the bent portion 134*n* of the developer accommodating member 134 is a contact portion where the developer accommodating member 134 contacts the top surface 117*a* of the first frame 17.

As shown in (b) of FIG. 13, in a state in which the top surface 117*a* of the first frame 117 contacts the bent portion 134*n* of the developer accommodating member 134, the top surface 117*a* of the first frame 117 and the top surface 134*k* of the developer accommodating member 134 are placed in the following relationship. That is, an angle formed, in a side of the developer accommodating container 126, between the surface 134*f* and the top surface 117*a* of the first frame 117 is larger than an angle formed, inside the developer accommodating container 126, between the top surface 134*k* and the surface 134*f*.

Further, the developer accommodating container 126 has the flexibility, and therefore the developer accommodating container 126 is depressed and deformed in the mounting direction E by the top surface 117*a* of the first frame 117. At this time, the inside air is, similarly as in Embodiment 1, evacuated through an air-permeable member 116 of the developer accommodating container 126 with respect to an arrow H direction of (b) of FIG. 12, so that a developer 39 inside the developer accommodating container 126 is compressed with a high density. As a result, the developer accommodating container 126 molded so as to be larger than the frame 140 can be accommodated between the first and second frames 117 and 118.

Here, a relationship of forces exerted from the top surface 117*a* of the first frame 117 to the surface 134*f* including the opening 135 of the developer accommodating member 134 to the surface 134*j* opposing the surface 134*f* of the developer accommodating member 134 is shown below.

As shown in (b) of FIG. 13, a force in an arrow F direction perpendicular to the top surface 117*a* of the first frame 117 acts on a bent portion 134*n* of the developer accommodating member 134. Here, the bent portion 134*n* connecting the top surface 134*k* (third side) and the surface 134*f* is a contact portion with the top surface 117*a* of the first frame 117. Therefore, the forces exerted on the surface 134*f* of the developer accommodating member 134 can be represented by the following formulas, respectively, by using the above-described angle θ13.

[Forces Exerted on Bent Portions]

Force component parallel to surface 134*f* including opening 135: F3*x*

$$F3x=F\times\cos|\theta13-90°|$$

Force component perpendicular to surface 134*f* including opening 135: F3*y*

$$F3y=F\times\sin|\theta13-90°|$$

Force component parallel to top surface 117*a* of the first frame 117: F3*yy*

$$F3yy = F\times\sin|\theta13-90°|\times\cos|\theta13-90°|$$
$$= F\times(\sin(2\times|\theta13-90°|))/2$$

Here, the angle θ13 as an interior angle formed between the top surface 117*a* of the first frame 117 and the surface 134*f* including the opening 135 of the developer accommodating member 134 satisfies a relationship of 90°<(angle θ13)<180°. Therefore, the force F3*yy* as a component force of the force, in the arrow F direction, acting on the top surface 117*a* with respect to the perpendicular direction satisfies F3*yy*>0, and thus acts in the arrow Q direction of (b) of FIG. 13.

Therefore, the bent portion 134*n* of the developer accommodating container 126 is moved in the arrow Q direction, so that the force F3*x* exerted on the surface 134*f* including the opening 135 is released.

Then, the surface 134*f* including the opening 135 of the developer accommodating member 134 falls toward the inside of the developer accommodating member 134 (in the arrow Q direction of (b) of FIG. 13). As a result, the depressed developer accommodating container 126 is accommodated in the hatched portion K indicated in (a) of FIG. 13. For this reason, it becomes possible to accommodate the developer accommodating container 126 between the first and second frames 117 and 118 while preventing folding and crease at the surface 134*f* including the opening 135.

From the above, as shown in (c) of FIG. 13, similarly as in Embodiment 4, the developer accommodating container 26 is molded so as to be larger than the frame 140, but can be accommodated between the first and second frames 117 and 118, so that it becomes possible to efficiently accommodate the developer.

Further, it becomes possible to prevent the deformation of the opening 135 by preventing the surface 134*f* including the opening 135 from generating the folding and crease, so that it is possible to stably supply the developer 139.

Further, in the above-described embodiments, the developer accommodating unit (or the developing device) in the process cartridge was described as an example but the present invention is not limited thereto. The present invention is also effective even in a developer accommodating unit (or a developing device) which is provided separately from the process cartridge and which is detachably mountable to the image forming apparatus. Further, in the embodiments described above, the constitution (developing device) in which the developer accommodating unit integrally includes the developing roller as the developer carrying member was shown as an example, but as described above, the present invention is also effective with respect to the developer accommodating unit from which the developing roller is provided separately.

Further, in the above-described embodiments, the constitution in which the process cartridge including the photosensitive drum is detachably mountable to the image forming apparatus was illustrated, but the present invention is not limited thereto. For example, it is also possible to use an image forming apparatus in which respective constituent members are incorporated or an image forming apparatus to which the respective constituent members are detachably mountable.

Further, in the embodiments described above, the printer is illustrated as the image forming apparatus, but the present invention is not limited thereto. For example, it is possible to use other image forming apparatuses such as a copying machine, a facsimile machine and a multi-function machine having functions of these machines. By applying the present invention to those image forming apparatuses, a similar effect can be obtained.

According to the present invention, it is possible to provide the developer accommodating unit, the developing device, the process cartridge and the image forming apparatus which are long in lifetime without upsizing the frame. Further, by decreasing a degree of the deformation due to the repelling force of the deformable flexible container, it is possible to prevent a lowering in image quality due to the deformation of the frame.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 273200/2012 filed Dec. 14, 2012, 019145/2013 filed Feb. 4, 2013 and 236404/2013 filed Nov. 15, 2013, which are hereby incorporated by reference.

What is claimed is:

1. A developer accommodating unit for accommodating developer, said developer accommodating unit comprising:

a flexible container, provided with an opening for permitting discharge of the developer, for accommodating the developer;

a sealing member for sealing the opening; and a frame, including a first frame and a second frame, for accommodating said flexible container in a space formed by mounting said first frame to said second frame and for accommodating the developer discharged through the opening of said flexible container when said sealing member is peeled off to unseal the opening, wherein, if a longitudinal end top surface of said flexible container is depressed in a mounting direction of said first frame toward said second frame, a longitudinal end side surface of said flexible container adjacent to the longitudinal end top surface is deformed and extends towards outside of said flexible container with respect to a longitudinal direction of said flexible container.

2. A developer accommodating unit according to claim 1, wherein between said longitudinal end side surface of said flexible container and a longitudinal end surface of said frame, a spacing is provided.

3. A developer accommodating unit according to claim 2, wherein said longitudinal end side surface of said flexible container is inclined with respect to the mounting direction.

4. A developer accommodating unit according to claim 2, wherein a thickness of said longitudinal end side surface of said flexible container is thinner than a thickness of a side of said flexible container provided with respect to a direction crossing the mounting direction.

5. A developer accommodating unit according to claim 1, wherein a largest distance between a first frame opposing surface and a second frame opposing surface of said flexible container at longitudinal end portions with respect to the mounting direction is larger than a largest distance between a first frame opposing surface and a second opposing surface of said flexible container at a longitudinal central portion with respect to the mounting direction.

6. A developer accommodating unit according to claim 1, wherein said flexible container is constituted by a molded portion and an air-permeable portion.

7. A developer accommodating unit according to claim 1, further comprising unsealing means for exposing the opening by moving said sealing member.

8. A developing device comprising:

a developer carrying member for developing a latent image, with a developer, formed on an image bearing member; and a developer accommodating unit according to claim 1.

9. A developing device according to claim 8, wherein said a flexible container is provided with a plurality of openings.

10. A process cartridge comprising:

an image bearing member;

a developer carrying member for developing a latent image, with a developer, formed on said image bearing member; and a developer accommodating unit according to claim 1.

11. A process cartridge according to claim 10, wherein said a flexible container is provided with a plurality of openings.

12. An image forming apparatus comprising:

conveying means for conveying a recording material;

an image bearing member;

a developer carrying member for developing a latent image, with a developer, formed on said image bearing member; and a developer accommodating unit according to claim 1.

13. An image forming apparatus according to claim 12, wherein said a flexible container is provided with a plurality of openings.

14. A developer accommodating unit according to claim 1, wherein said flexible container has a first surface where the opening is provided, and is deformed in contact with said first frame or said second frame when said first frame and said second frame are connected with each other, and thus said first surface falls toward an inside of said flexible container.

15. A developer accommodating unit according to claim 1, wherein a projected portion projects in a direction crossing the mounting direction.

16. A developer accommodating unit according to claim 1, wherein said longitudinal end top surface of said flexible container is depressed in contact with one of said plurality of frames.

17. A developer accommodating unit according to claim 1, wherein said longitudinal end top surface of said flexible container is depressed in the mounting direction so that a projected portion projects in a direction crossing the mounting direction.

18. A developer accommodating unit according to claim 1, wherein a longitudinal direction of said flexible container crosses the mounting direction.

19. A developer accommodating unit according to claim 1, wherein said flexible container has an end portion surface and a central portion surface which are provided along a direction crossing the mounting direction.

20. A developer accommodating unit according to claim 1, wherein said flexible container has one end portion surface, a central portion surface, and another end portion surface which are provided along a direction crossing the mounting direction in this order.

21. A developer accommodating unit according to claim 1, wherein said a flexible container is provided with a plurality of openings.

22. A developer accommodating unit comprising:

a plurality of frames; and a developer accommodating member, accommodated between said plurality of frames, for accommodating developer used for image formation, wherein said developer accommodating member is provided with an opening for permitting discharge of the developer when a sealing member is peeled off to expose the opening, wherein said developer accommodating member has a first surface where the opening is provided, and a second surface adjacent to said first surface, and wherein, if said second surface is depressed, said first surface falls toward an inside of said developer accommodating member to accommodate said developer accommodating member in said plurality of frames.

23. A developer accommodating unit according to claim 22, wherein one of said plurality of frames has a contact surface contacting said developer accommodating member when said plurality of frames are connected with each other, wherein said developer accommodating member has a third surface provided in an opposing position to said first surface, wherein, said second surface is contacted by said one of said plurality of frames when said plurality of frames are connected with each other, and wherein, when said plurality of frames are connected with each other in a state in which said developer accommodating member contacts said one of said plurality of frames, an angle formed inside of said developer accommodating member between said first surface and said contact surface of said one of said plurality of frames is larger than an angle formed inside of said developer accommodating member between said third surface and said contact surface.

24. A developer accommodating unit according to claim 23, wherein said second surface is, when said plurality of frames are connected with each other, in parallel to said contact surface of said one of said plurality of frames in a state in which said developer accommodating member and said one of said plurality of frames are in contact with each other.

25. A developer accommodating unit according to claim 23, wherein a space in which a part of said developer accommodating member is accommodated by falling of said third surface toward and outside of said developer accommodating member is provided.

26. A developer accommodating unit according to claim 22, wherein one of said plurality of frames has a contact surface contacting said developer accommodating member when said plurality of frames are connected with each other, wherein said developer accommodating member has a third surface provided in an opposing position to said first surface, wherein said second is contacted by said one of said plurality of frames when said plurality of frames are connected with each other, wherein said developer accommodating member has a bent portion between said first surface and said second surface, and wherein, when said plurality of frames are connected with each other, in a state in which said bent portion of said developer accommodating member contacts said contact surface of said one of said plurality of frames, an angle formed in a side of said developer accommodating member between said first surface and said contact surface of said one of said plurality of frames is greater than 90 degrees and is less than 180 degrees.

27. A developer accommodating unit according to claim 26, wherein when said plurality of frames are connected with each other in a state in which said bent portion of said developer accommodating member contacts said contact surface of said one of said plurality of frames, the angle formed in said side of said developer accommodating member between said first surface and said contact surface of said one of said plurality of frames is larger than an angle formed inside of said developer accommodating member between said second surface and said first surface.

28. A developer accommodating unit according to claim 22, wherein at least a part of said developer accommodating member is provided with an air-permeable member.

29. A developer accommodating unit according to claim 22, wherein at least one of said plurality of frames is provided with a fixing portion for fixing said developer accommodating member.

30. A developer accommodating unit for accommodating developer, said developer accommodating unit comprising:

a flexible container, provided with an opening for permitting discharge of the developer, for accommodating the developer;

a sealing member for sealing the opening; and a frame, including a first frame and a second frame, for accommodating said flexible container in a space formed by mounting said first frame to said second frame and for accommodating the developer discharged through the opening of said flexible container when said seal member is peeled off to unseal the opening, wherein, if a longitudinal end top surface of said flexible container is depressed in a mounting direction of said first frame toward said second frame, a longitudinal end side surface of said flexible container adjacent to the longitudinal end top surface is deformed and extends toward an outside of said flexible container with respect to a longitudinal direction of said flexible container, and wherein, if a longitudinal end top surface of said flexible container is depressed in a mounting direction of said first frame toward said second frame, a space between said longitudinal end side surface of said flexible container and a longitudinal end surface of said frame reduces.

* * * * *